US005819133A

United States Patent [19]

Matsuzoe et al.

[11] Patent Number: 5,819,133

[45] Date of Patent: Oct. 6, 1998

[54] TRANSVERSE TYPE IMAGE FORMING APPARATUS

[75] Inventors: Hisanobu Matsuzoe, Chikushino; Kouji Migita, Fukuoka-ken; Kazuo Hakukawa, Fukuoka; Yasunori Sagara, Kasuga; Shinichi Kizu, Fukuoka; Yusuke Shiibara; Masashi Ogawa, both of Kasuga; Yukinori Hara, Fukuoka-ken, all of Japan

[73] Assignee: Matsushita Electric Industrial Co., Ltd., Osaka, Japan

[21] Appl. No.: 768,330

[22] Filed: Dec. 17, 1996

[30] Foreign Application Priority Data

Dec. 18, 1995 [JP] Japan ..... 7-328600
Sep. 25, 1996 [JP] Japan ..... 8-252585

[51] Int. Cl.[6] ..... G03G 15/14

[52] U.S. Cl. ..... 399/66; 399/163; 399/297

[58] Field of Search ..... 399/66, 155, 162, 399/163, 297, 303, 313

[56] References Cited

U.S. PATENT DOCUMENTS 4,855,784 8/1989 Bujese ..... 399/297
4,894,686 1/1990 Bujese ..... 399/297
5,196,870 3/1993 Itoh et al. ..... 347/130
5,216,453 6/1993 Itoh ..... 399/297 X

FOREIGN PATENT DOCUMENTS 4-69254 3/1992 Japan .

*Primary Examiner*—Nestor R. Ramirez
*Attorney, Agent, or Firm*—Watson Cole Stevens Davis, P.L.L.C.

[57] ABSTRACT

In an image forming apparatus of transverse transfer type, toner images, carried by a toner-image carrying member extended by a plurality of rollers in a direction perpendicular to a direction of feed of printing paper, are transferred by a transfer opposed roller to the printing paper in a direction perpendicular to the direction of feed of the printing paper to be fixed. Among the rollers extending the toner image-carrying member, at least one of those rollers except for the transfer opposed roller, which comes closest to the transfer opposed roller at starting and terminal ends of a longest path of movement of the transfer opposed roller, respectively, is provided at a position spaced from a transfer surface of the printing paper, to which the toner images are transferred, by a distance larger than a diameter of the transfer opposed roller. With this construction, a non-transfer region, in which the transfer opposed roller can not move, is reduced, and therefore a body of the image forming apparatus can be made smaller in size.

18 Claims, 17 Drawing Sheets

TRANSVERSE TYPE IMAGE FORMING APPARATUS

BACKGROUND OF THE INVENTION

1. Field of the Invention

This invention relates to an image forming apparatus of the transverse transfer type in which toner images are transferred to a printing paper in a direction perpendicular to a direction of feed of the printing paper.

2. Description of the Related Art

Recently, image forming apparatuses of the toner type, capable of forming a clear image with a high resolution, have been extensively used, and a representative example of such apparatuses is a laser beam printer. Among such image forming apparatuses of the toner type, an image forming apparatus of the transverse transfer type (disclosed, for example, in Japanese Patent Unexamined Publication No. 4-69254), in which a toner image-carrying member is rubbed or pressed against a printing paper in a direction perpendicular to a direction of feed of the printing paper to thereby transfer toner images bit by bit (or step by step) to the printing paper, is very suitable for achieving a small-size design of the apparatus.

Such a conventional image forming apparatus of the transverse transfer type will be described below.

FIG. 24 is a schematic view showing an image forming process in a conventional image forming apparatus, and FIG. 25 is a schematic view showing a transfer process in a conventional image forming apparatus.

The image forming process will be first described with reference to FIG. 24. A belt-like toner image-carrying member 1, comprising a non-photosensitive material, is extended by a plurality of rollers and so on to be disposed in a direction perpendicular to a direction of feed of printing paper 2, and when forming an image, this toner image-carrying member 1 is revolved in a direction indicated by arrows, so that toner images are formed on the surface of the toner image-carrying member 1. The plurality of rollers and so on, which extend the toner image-carrying member 1, include support rollers 3 and 4 (serving also as end rollers as described later), a displacement roller 5 suitably displaceable for adjusting the tension of the toner image-carrying member 1, and electrostatic latent image-forming means 6 for forming an electrostatic latent image. The electrostatic latent image-forming means 6 comprises a photosensitive drum 6*a*, and exposure means (LED chip) for forming an electrostatic latent image on the surface of the photosensitive drum 6*a*. A toner is not caused to adhere directly to this electrostatic latent image, but the electrostatic latent image is used to form a pseudo electrostatic latent image on the toner image-carrying member 1. By electric lines of force produced by the electrostatic latent image, a pseudo electrostatic latent image is formed on a surface of the toner image-carrying member 1 which is caused to be in contact with the photosensitive drum 6*a*, and developing means 7 is brought into contact with this pseudo electrostatic latent image, thereby causing a toner to adhere to the pseudo electrostatic latent image to form a toner image. This image forming method is much like a method in which a magnet is put on a reverse surface of a paper sheet, and iron powder is distributed over an obverse surface of the paper sheet, thereby forming an image on the paper sheet.

Next, the transfer process will be described with reference to FIG. 25. When the image forming operation for one step is finished in the image forming process, toner images, formed on the toner image-carrying member 1, are brought to a region which faces the printing paper 2 as the toner image-carrying member 1 revolves and extends between the support rollers 3 and 4. During the image formation, a transfer opposed roller 8 is kept retracted inwardly from the toner image-carrying member 1, and when transferring the toner images to the printing paper 2, the transfer opposed roller 8 is pressed toward the printing paper 2 to come into contact with the toner image-carrying member 1, and also the displacement roller 5 for adjusting the tension of the toner image-carrying member 1 is moved toward the printing paper 2. The transfer opposed roller 8, pressing the toner image-carrying member 1 against the printing paper 2, is reciprocally movable in a direction perpendicular to the feed direction (that is, a direction perpendicular to the sheet of FIG. 25) of the printing paper 2, and a transfer region P is determined by the longest path of movement of the transfer opposed roller 8. This longest movement path is obtained when selecting the printing paper 2 having the maximum printable width. End rollers 3 and 4 come closest to the transfer opposed roller 8 respectively at the starting end and the terminal end of the longest movement path above-mentioned end rollers 3 and 4. Namely, the two end rollers 3 and 4 are provided respectively at the starting end and terminal end of the longest movement path, and in this conventional construction, the support rollers 3 and 4 serve as the end rollers, respectively.

In the transfer process of FIG. 25, the rotating transfer opposed roller 8 rotatingly moves from left to right in the transfer region P between the support rollers 3 and 4 to transfer the toner images, formed on the toner image-carrying member 1, onto the printing paper 2. At this time, a transfer finish surface Z of the toner image-carrying member 1 where the transfer of the toner images has been finished is gradually moved away from the printing paper 2 as the transfer opposed roller 8 passes the transfer finish surface Z. In this conventional construction, the process of transferring the toner images to the printing paper 2 and the process of fixing the toner images thus transferred to the printing paper 2 are carried out simultaneously, and toner particles on the printing paper 2 are fused by a heat source, provided either on the transfer opposed roller 8 or a platen 9, to be fixed. After the transfer for one step is finished, the transfer opposed roller 8 is again retracted inwardly from the toner image-carrying member 1, and the above-mentioned image forming process is effected, and also the printing paper 2 is fed by an amount corresponding to an effective transfer width of the toner image-carrying member 1.

In the above conventional image forming apparatus, however, as shown in FIG. 25, the transfer opposed roller 8 is brought into contact with the support rollers (end rollers) 3 and 4 and is thus limited in movement, and therefore the transfer opposed roller 8 can reciprocally move only in the transfer region P extending between the support rollers 3 and 4. Thus non-transfer regions R where the transfer opposed roller 8 can not move are formed in a region corresponding to a longitudinal width Q of the toner image-carrying member 1 determined by the arrangement of the support rollers 3 and 4. Therefore, when arranging the support rollers (end rollers) 3 and 4 which determine the longitudinal width Q of the tone image-carrying member 1, not only the transfer region P but also the right and left non-transfer regions R must be taken into consideration, and there has been encountered a problem that these non-transfer regions R hinder achievement of a compact design of the image forming apparatus.

SUMMARY OF THE INVENTION

It is therefore an object of this invention to provide an image forming apparatus in which non-transfer regions where a transfer opposed roller can not move are eliminated or reduced, thereby achieving a compact (small-size) design of an apparatus body.

To attain the above object, the invention provides an image forming apparatus of transverse transfer type for transferring toner images, which are carried by a toner image carrying member stretched around a plurality of rollers in a direction perpendicular to a feeding direction of a printing paper, to the printing paper by means of a transfer opposed roller to adhere the toner images transferred to the printing paper, and wherein at least one of the rollers, which are among said rollers stretching said toner image carrying member therearound but other than said transfer opposed roller and come closest to said transfer opposed roller at starting or terminal ends of a longest movement path of said transfer opposed roller, is spaced a greater distance in a direction perpendicular to a surface of the printing paper than a diameter of said transfer opposed roller from a surface of the printing paper, to which toner images are transferred. With the above arrangement, a non-transfer region, in which the transfer opposed roller cannot move, within a longitudinal width of the toner image carrying member can be reduced, which makes a body of the image forming apparatus small in size.

Also, the invention provides an image forming apparatus of transverse transfer type for transferring toner images, which are carried by a toner image carrying member stretched around a plurality of rollers in a direction perpendicular to a feeding direction of a printing paper, to the printing paper by means of a transfer opposed roller to adhere the toner images transferred to the printing paper, and wherein while said transfer opposed roller performs transfer of the toner images, that surface of said toner image carrying member, on which transfer has finished, is not moved away from the printing paper. With the above arrangement, the transfer finished surface will not be loosened, so that tension of the toner image carrying member is kept constant before and behind the transfer opposed roller to improve a transfer accuracy.

In an aspect of the invention, at least one of the rollers, which are among the rollers stretching said toner image carrying member therearound but other than the transfer opposed roller and come closest to said transfer opposed roller at the starting and terminal ends of the longest movement path of the transfer opposed roller, comprises a displacement roller which is displaced following movements of the transfer opposed roller. With the above arrangement, the displacement roller is improved in followability with respect to the transfer opposed roller, and looseness of the toner image carrying member caused by movements of the transfer opposed roller can be efficiently eliminated.

In another aspect of the invention, the toner image carrying member comprises a photosensitive belt, and further comprising exposure means for exposing the toner image carrying member in accordance with image signals, and developing means for developing the toner image carrying member. With the above arrangement, a non-transfer region, in which the transfer opposed roller cannot move, within a longitudinal width of the toner image carrying member can be reduced, which makes a body of the image forming apparatus small in size.

In further aspect of the invention, there are further provided exposure means for simultaneously exposing the toner image carrying member at one line in accordance with image signals for respective four primary colors, and developing means for providing toners of respective four primary colors and forming toner layers on the same developing roller for respective four primary colors. With the above arrangement, a non-transfer region, in which the transfer opposed roller cannot move, within a longitudinal width of the toner image carrying member can be reduced, which makes a body of the image forming apparatus small in size.

In still another aspect of the invention, while the transfer opposed roller performs transfer of the toner images, that surface of the toner image carrying member, on which transfer has finished, is sequentially moved away from the printing paper. With the above arrangement, a non-transfer region, in which the transfer opposed roller cannot move, within a longitudinal width of the toner image carrying member can be reduced, which makes a body of the image forming apparatus small in size.

In still further aspect of the invention, while transfer of the toner images is performed, the rollers except for the transfer opposed roller and the displacement roller which is displaced following movements of the transfer opposed roller to impart tension to the toner image carrying member are rotated. With the above arrangement, looseness of the transfer finished surface of the toner image carrying member during the transfer of the toner images is actively taken to enable keeping tension of the toner image carrying member before and behind the transfer opposed roller constant, so that slippage of the transfer opposed roller is eliminated to improve a transfer accuracy.

In another aspect of the invention, while transfer of the toner images is performed, the rollers except for the transfer opposed roller and the displacement roller which is displaced following movements of the transfer opposed roller to impart tension to the toner image carrying member are enabled to be rotated. With the above arrangement, looseness of the transfer finished surface of the toner image carrying member during the transfer of the toner images is actively taken to enable keeping tension of the toner image carrying member before and behind the transfer opposed roller constant, so that slippage of the transfer opposed roller is eliminated to improve a transfer accuracy.

In further aspect of the invention, while the transfer opposed roller performs transfer of the toner images, that surface of the toner image carrying member, on which transfer has finished, is not moved away from the printing paper. With the above arrangement, looseness of the transfer finished surface during the transfer of the toner images is not produced, so that tension of the toner image carrying member is kept constant before and behind the transfer opposed roller constant to improve a transfer accuracy.

In still another aspect of the invention, three or more rollers including the transfer opposed roller and the displacement roller which is displaced following movements of the transfer opposed roller revolve the toner image carrying member to form toner images. With the above arrangement, a non-transfer region, in which the transfer opposed roller cannot move, within a longitudinal width of the toner image carrying member can be reduced, which makes a body of the image forming apparatus small in size.

In still further aspect of the invention, two or more rollers including the displacement roller, which is displaced following movements of the transfer opposed roller, but not including the transfer opposed roller revolve the toner image carrying member to form toner images. With the above arrangement, the transfer opposed roller does not revolve the toner image carrying member during the formation of images, so that tension of the toner image carrying member is made more stable to improve an accuracy of image formation.

DESCRIPTION OF THE PREFERRED EMBODIMENTS

Figure 1:
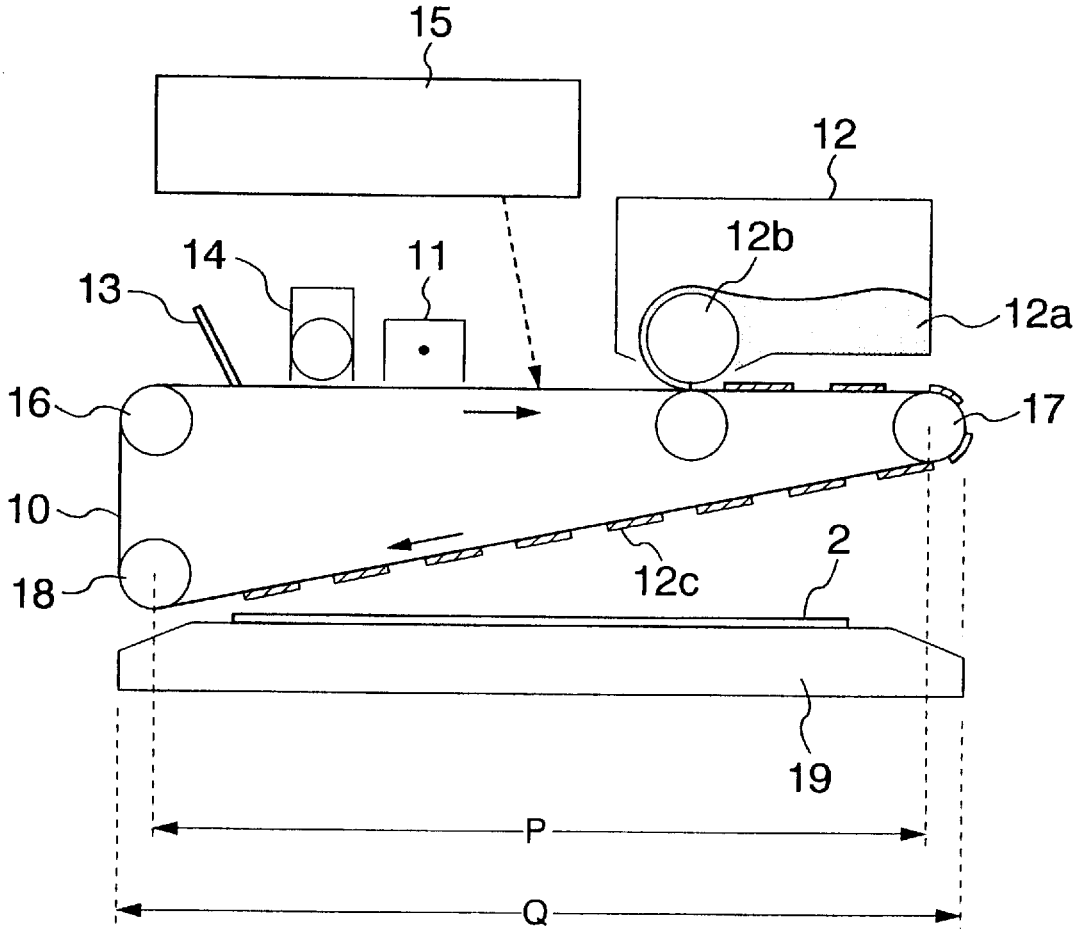
FIG. 1 is a schematic view showing a construction of an image forming apparatus according to a first embodiment of the invention.

Preferred embodiments of the present invention will now be described with reference to FIGS. 1 to 23, and those portions identical, respectively, to those of a conventional construction will be designated by identical reference numerals, respectively.

In the present invention, those rollers, which come closest to a transfer opposed roller at respective starting and terminal ends of a longest path of movement of the transfer opposed roller (obtained when selecting a printing paper having a maximum printable width) during an image transfer operation, will be called "end rollers", respectively.

In a first embodiment of the present invention, left and right end rollers (disposed at the starting end and the terminal end of the longest movement path) are provided at such a height or level that the transfer opposed roller will not contact the left and right end rollers, and with this arrangement limitations imposed on the end rollers are eliminated, thereby totally eliminating non-transfer regions where the transfer opposed roller can not move. The first embodiment of the present invention will now be described in detail with reference to FIGS. 1 to 5.

Figure 2:
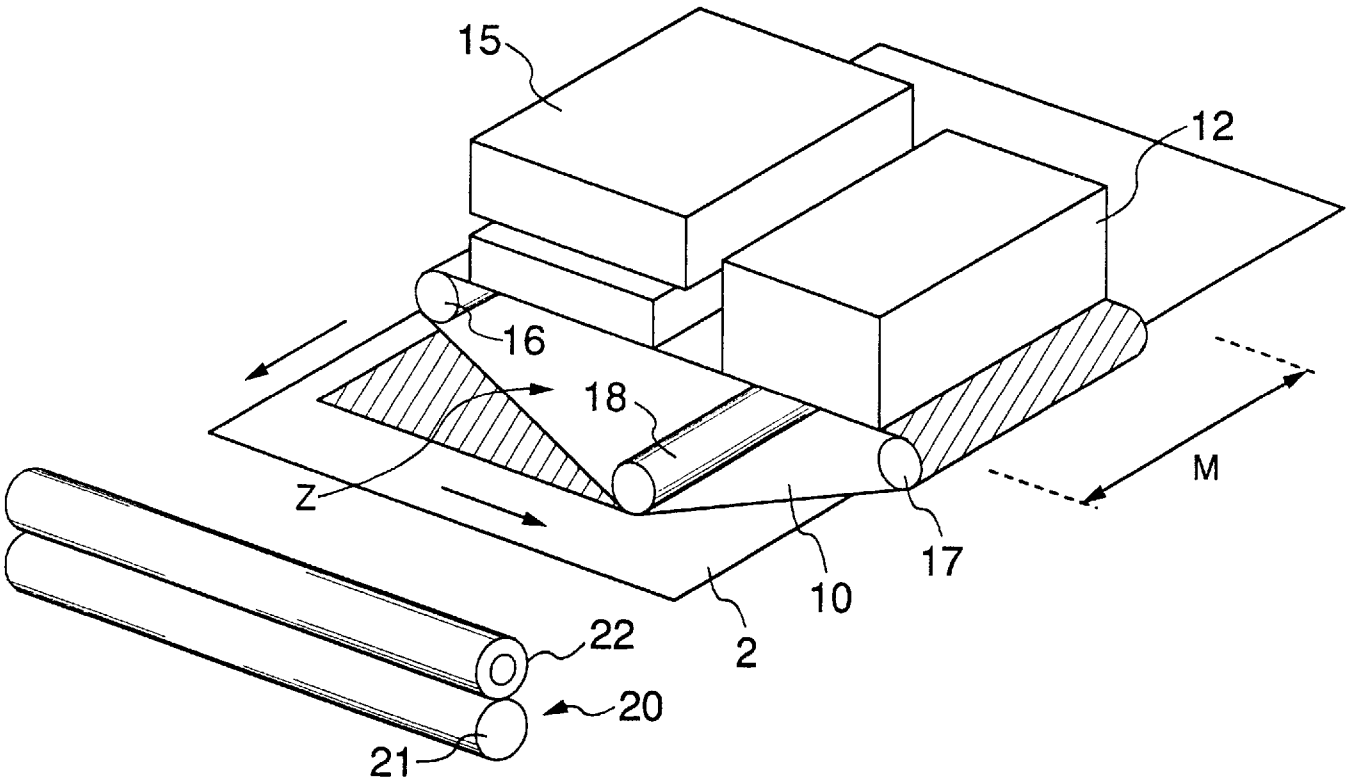
FIG. 2 is a perspective view showing a transfer process performed in the image forming apparatus of the first embodiment.
Figure 3:
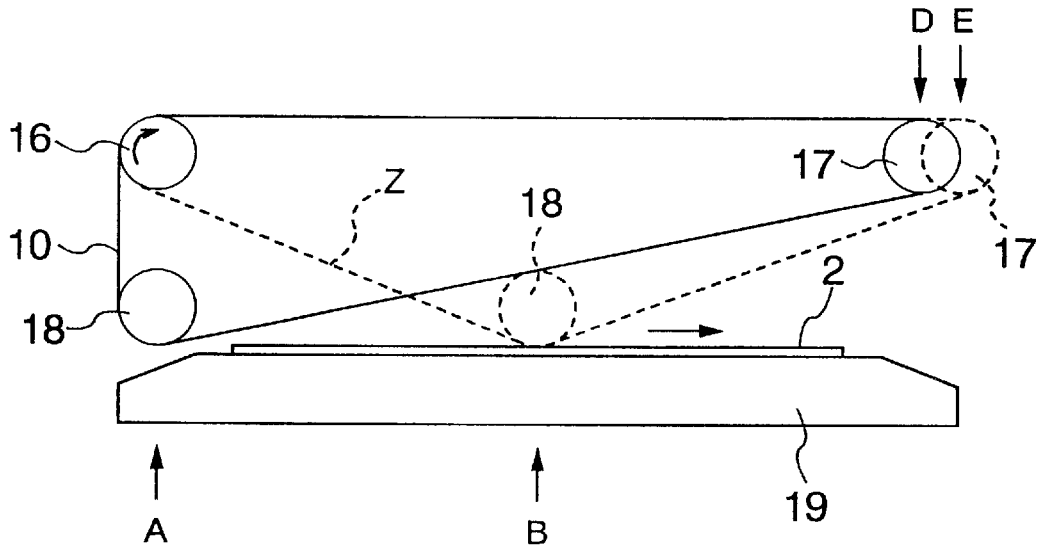
FIGS. 3 and 4 are schematic views showing displacement of a toner image-carrying member in the image forming apparatus of the first embodiment.
Figure 4:
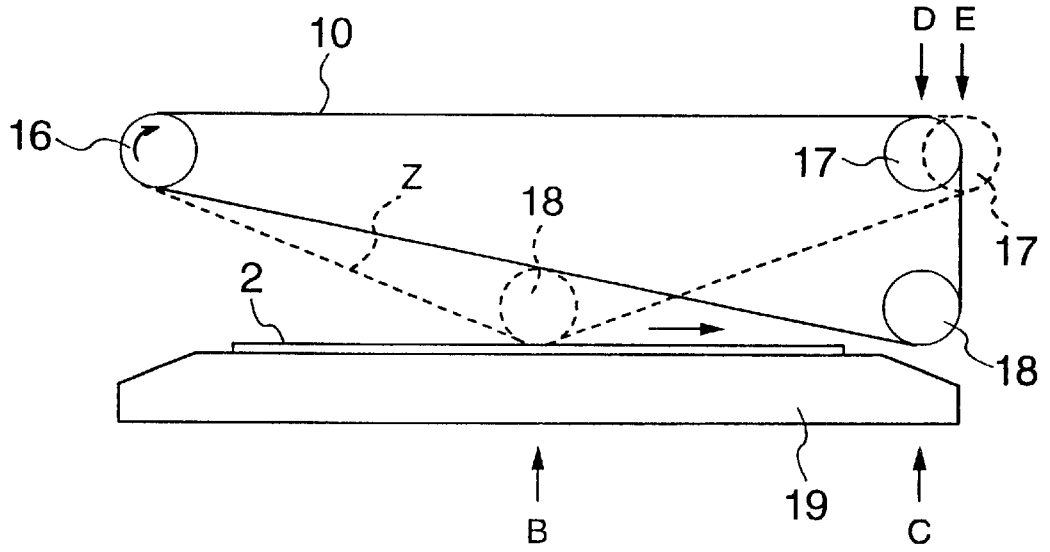
Figure 5:
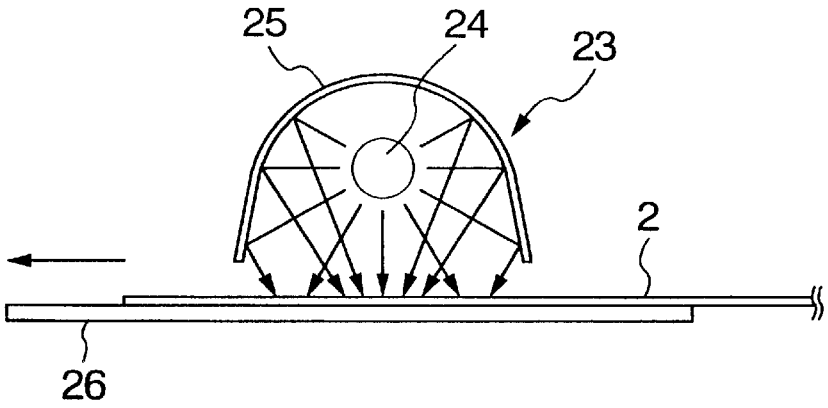
FIG. 5 is a schematic view showing fixing means of the image forming apparatus of the first embodiment.

FIG. 1 is a schematic view showing a construction of an image forming apparatus according to the first embodiment of the invention, and FIG. 2 is a perspective view showing a transfer process performed in the image forming apparatus of the first embodiment. FIGS. 3 and 4 are schematic views showing displacement of a toner image-carrying member in the image forming apparatus of the first embodiment, and FIG. 5 is a schematic view showing fixing means of the image forming apparatus of the first embodiment.

In FIGS. 1 and 2, the toner image-carrying member 10 is in the form of a photosensitive belt having a surface coated with an organic photoconductive material, and is extended by a plurality of rollers in a direction perpendicular to a direction of feed of printing paper 2, and when forming images, this toner image-carrying member 10 is revolved in a direction indicated by arrows, so that toner images are formed on the surface of the toner image-carrying member 10. Static charging means 11, developing means 12, cleaning means 13, static eliminating means 14 and so on are provided around the toner image-carrying member 10, and exposure means 15 for radiation of a laser beam is provided above the toner image-carrying member 10. In this first embodiment, although the exposure means 15 is described as typically using a laser, an LED or LCD may be used in the exposure means 15. When the toner image-carrying member 10 is revolved in the direction (indicated by the arrows in FIG. 1) perpendicular to the direction of feed of the printing paper 2, that portion of the toner image-carrying member 10 which has passed past the static charging means 11 is electrically charged uniformly at about −600 V, and a potential of that portion of the toner image-carrying member 10, to which a laser beam is radiated from the exposure means 15 in accordance with an image signal, rises to about −100 V, so that an electrostatic latent image is formed on this portion. When a toner 12*a* is applied by a developing roller 12*b* to this portion having the electrostatic latent image thereon, a toner image (visible image) 12*c* appears on the toner image-carrying member 10. Thus, during the revolution of the toner image-carrying member 10, the toner images 12*c* successively appear on the toner image-carrying member 10.

As shown in FIG. 1, during the image forming operation, the toner image-carrying member 10 is extended by at least three rollers, that is, support roller 16, displacement roller 17 and transfer opposed roller 18 in the direction perpendicular to the direction of feed of the printing paper 2. A longest path of movement of the transfer opposed roller 18 is obtained when selecting the printing paper 2 having a maximum printable width, and those rollers, which come closest to the transfer opposed roller 18 at respective starting and terminal ends (i.e., left end and right end in FIG. 1) of the longest movement path, are made the end rollers. In this first embodiment, the support roller 16 and the displacement roller 17, which are provided respectively at the left and right ends of the longest movement path, correspond to the end rollers, respectively. The displacement roller 17 is suitably displaceable so as to adjust tension of the toner image-carrying member 10, and the transfer opposed roller 18 rolls in opposed relation to a transfer plate 19 to transfer to the printing paper 2 the toner images 12*c* on the toner image-carrying member 10. In this first embodiment, since the support roller 16 and the displacement roller 17, serving also as the end rollers, are arranged at such a height as not to contact the transfer opposed roller 18, the non-transfer regions R, which have been problematic with the conventional construction of FIGS. 24 and 25 and in which the transfer opposed roller 18 can not move, are eliminated. Therefore, the transfer opposed roller 18 can move between the left end roller 16 and the right end roller 17, that is, over an entire longitudinal width Q of the toner image-carrying member 10, so that a transfer region P where the transfer opposed roller 18 can move is greatly increased.

In FIGS. 3 and 4, the displacement roller 17 is displaced as the transfer opposed roller 18 moves, and is displaced left and right so as to remove looseness of the toner image-carrying member 10 due to the movement of the transfer opposed roller 18. For example, when the transfer opposed roller 18 moves from a left end A to an intermediate point B as shown in FIG. 3, the displacement roller 17 moves from a left end D to a right end E. When the transfer opposed roller 18 moves from the intermediate point B to a right end C as shown in FIG. 4, the displacement roller 17 returns from the right end E to the left end D. When forming the toner images on the toner image-carrying member 10, the transfer opposed roller 18 is fixed at the left end A (FIG. 3) or the right end C (FIG. 4), and the toner image-carrying member 10 is kept in a floating condition as indicated by a solid line to be revolved without displacement, so that the toner images 12*c* thereon are brought into opposed relation to the printing paper 2.

It is to be noted that the toner image-carrying member 10 is revolved when the transfer opposed roller 18 is located at either the left end A or the right end C, and that the toner image-carrying member 10 is stopped while the transfer opposed roller 18 moves over the printing paper 2. Namely, the revolution of the toner image-carrying member 10 and the movement of the transfer opposed roller 18 are exclusive events with respect to each other, and do not occur at the same time.

However, the exclusive events are theoretical, and actually in order to keep the tension of the toner image-carrying member 10 at a constant level on the opposite (front and rear) sides of the transfer opposed roller 18, the support roller 16 is, in some cases, minutely rotated (almost slided), and strictly a slight discordance occurs. A method of keeping the tension of the toner image-carrying member 10 at a constant level before and behind the transfer opposed roller 18 will be described in detail.

When the transfer opposed roller 18 moves from the left end A to the right end C in the going path (or the going stroke) as shown in FIGS. 3 and 4, a transfer finish surface Z of the toner image-carrying member 10 develops on the left side (rear side) of the transfer opposed roller 18 as the transfer opposed roller 18 moves. This transfer finish surface Z is kept spaced from the printing paper 2 to be extended tense by the transfer opposed roller 18 and the support roller 16. However, since the transfer opposed roller 18 moves while being rotated, a forward portion (which has not yet undergone transfer) of the toner image-carrying member 10 disposed in the direction of advance of the transfer opposed roller 18 is pulled by the transfer opposed roller 18 to be increased in tension whereas the transfer finish surface Z, disposed rearwardly of the transfer opposed roller 18 in the direction of advance, tends to be slightly loosened to be reduced in tension. When a tension difference thus develops between the forward and rearward portions of the toner image-carrying member 10 disposed, respectively, before and behind the transfer opposed roller 18, the transfer opposed roller 18 is liable to slip, so that the precision of transfer of the toner images to the printing paper 2 is lowered. In order to prevent the transfer precision from being lowered, the tension of the toner image-carrying member 10 need to be kept at a constant level before and behind the transfer opposed roller 18 as much as possible, and therefore the support roller 16, which is one of the two rollers for applying a tension to the transfer finish surface Z, is minutely rotated in a direction (i.e., a clockwise direction indicated by an arrow in FIGS. 3 and 4) to eliminate looseness on the transfer finish surface Z, thereby increasing the tension of the transfer finish surface Z. There are two methods of minutely rotating the support roller 16, and one method (active method) is to rotate the support roller 16 by a drive force, and in the other method (passive method), the support roller 16 affords a play to be made rotatable in a direction to eliminate looseness of the transfer finish surface Z. By adopting one of the two methods, the support roller 16 can be minutely rotated to eliminate the looseness of the transfer finish surface Z, and therefore the tension of the toner image-carrying member 10 can be kept at a constant level before and behind the transfer opposed roller 18.

For transferring the toner images to the printing paper 2, as shown in FIG. 2, the feed of the printing paper 2 is temporarily stopped to keep the printing paper 2 stationary on the transfer plate 19 (see FIG. 1), and also the revolution of the toner image-carrying member 10 is stopped. Then, those portions of the toner image-carrying member 10 on which the toner images 12*c* (FIG. 1) are formed, respectively, are sequentially pressed or rubbed against the printing paper 2 by rolling the transfer opposed roller 18 on the reverse side of the toner image-carrying member 10, thereby transferring the toner images 12*c* to the printing paper 2, and at this time the toner image-carrying member 10 is displaced from the left end to the right end or vice versa by an amount corresponding to the transfer operation for one step. At this time, the transfer finish surface Z of the toner image-carrying member 10 where the transfer of the toner images 12*c* has been finished is gradually moved away from the printing paper 2 as the transfer opposed roller 18 moves. During the transfer operation, the transfer plate 19, supporting the printing paper 2 thereon, is applied with a positive voltage to attract and separate the negatively-charged toner images 12*c* from the surface of the toner image-carrying member 10 to have the images transferred to the printing paper 2. The transfer operation by the toner image-carrying member 10 can be effected not only in the going path, but also in the return path (or the return stroke) as described above. At this time, when viewing the direction of movement of the toner image-carrying member 10 from the side of the printing paper 2, the toner image-carrying member 10 is displaced on the printing paper 2 in a direction perpendicular to the direction of feed of the printing paper 2.

Each time the transfer operation for one step is finished, the transfer opposed roller 18 passes over the printing paper 2, and moves to a region outside the printing paper 2, so that the toner image-carrying member 10 is spaced apart from the printing paper 2. Then, the feed of the printing paper 2 is started, and at this time the printing paper 2 is fed in an amount corresponding to an effective transfer width M (see FIG. 2) of the toner image-carrying member 10.

The cleaning means 13 removes the residual toner on the surface of the toner image-carrying member 10 by means of a cleaning blade or a cleaning brush, and the thus removed toner is recovered as waste toner. Thus, the cleaning means 13 physically cleans the surface of the toner image-carrying member 10. The static eliminating means 14 neutralizes the negative charge remaining on the surface of the toner image-carrying member 10 from which the residual toner has been removed, thus electrically cleaning the surface of the toner image-carrying member 10. The provision of the static eliminating means 14 is not essential.

After the above steps are repeated, the printing paper 2 is gradually fed to the fixing means 20 as shown in FIG. 2. In the fixing means 20, the printing paper 2, having the transferred images thereon, is held between a pressure roller 21 and a heating roller 22 containing a heat source therein, and the toner particles are fused by the heating roller 22 to be fixed to the printing paper 2. If this fixing operation is effected after all the images are transferred to the printing paper 2, the printing paper 2 is discharged without being stopped, and therefore the heat source of the heating roller 22 may be kept turned on. However, if the images are in the course of transfer to the printing paper 2, the printing paper 2 is in a stopped condition, and therefore the heat source of the heating roller 22 needs to be temporarily turned off, or the heating roller 22 needs to be moved away from the printing paper 2. Another fixing method as shown in FIG. 5 may be used, in which fixing means 23 comprises a heat source 24 and a reflection plate 25, and a reflection plate 26 is provided below the fixing means 23 so as to enhance a thermal efficiency, thereby effecting fixation without contacting the toner. In the manner described above, a series of image forming steps are finished.

As described above, in this first embodiment, the left and right end rollers (i.e., the support roller 16 and the displacement roller 17) are arranged at such a height as not to contact the transfer opposed roller 18, and with this arrangement the non-transfer regions R, which have been problematic with the conventional construction and in which the transfer opposed roller 18 can not move, are completely eliminated. As a result, the longitudinal width Q of the tone image-carrying member 10 can be reduced to a limit, so that the body of the image forming apparatus can be made small in size.

In a second embodiment of the present invention, one end roller is provided at such a height as not to contact with a transfer opposed roller, and with this arrangement a limitation imposed on the one end roller is eliminated, thereby eliminating a non-transfer region, in which the transfer opposed roller can not move, at one end of a path of movement of the transfer opposed roller. In contrast with the conventional construction, a transfer finish surface of a toner image-carrying member, for which the transfer of toner images has been finished, is not moved away from printing paper even after the transfer opposed roller passes the transfer finish surface, and therefore the tension of the toner image-carrying member is kept constant before and behind the transfer opposed roller, thereby enhancing the transfer precision. The second embodiment of the present invention will now be described with reference to FIG. 6 to 11 and FIG. 5.

Figure 6:
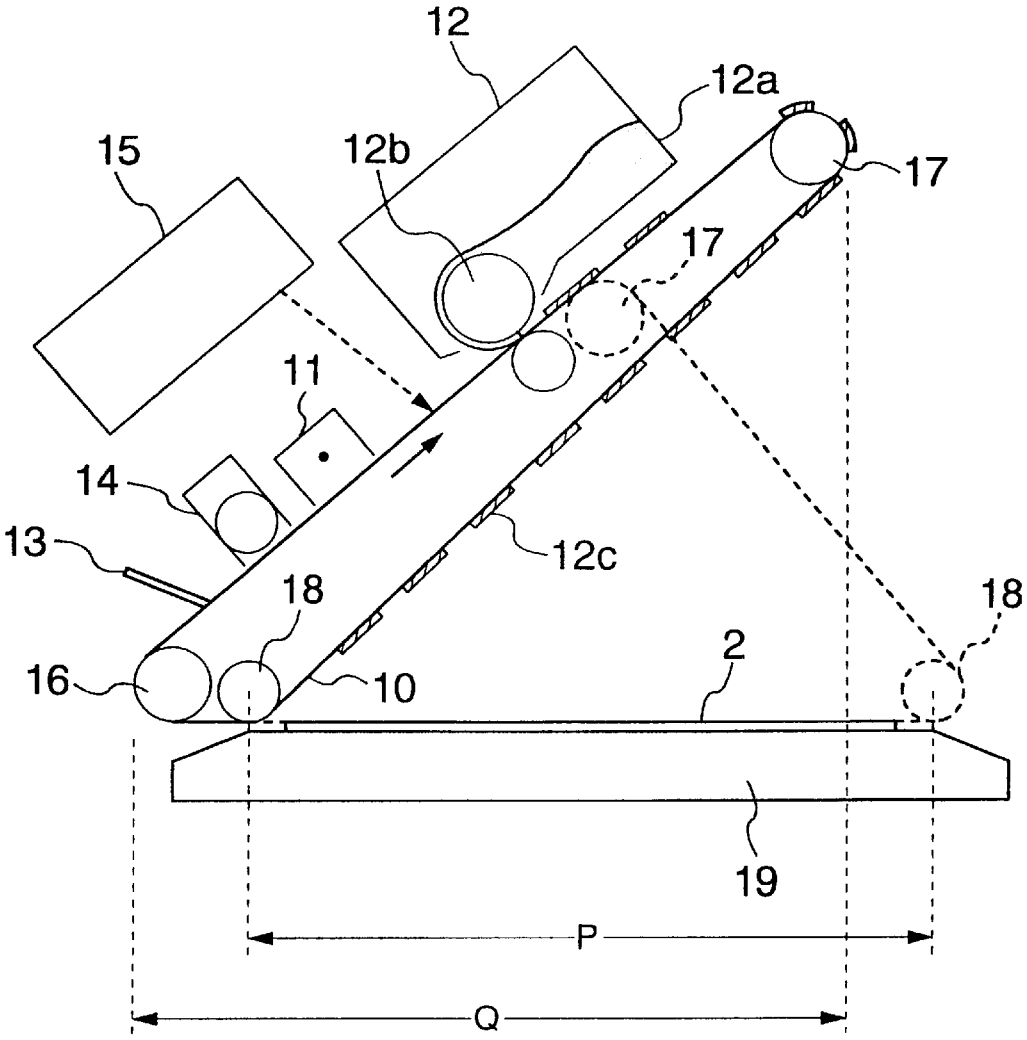
FIG. 6 is a schematic view showing a construction of an image forming apparatus according to a second embodiment of the invention.
Figure 7:
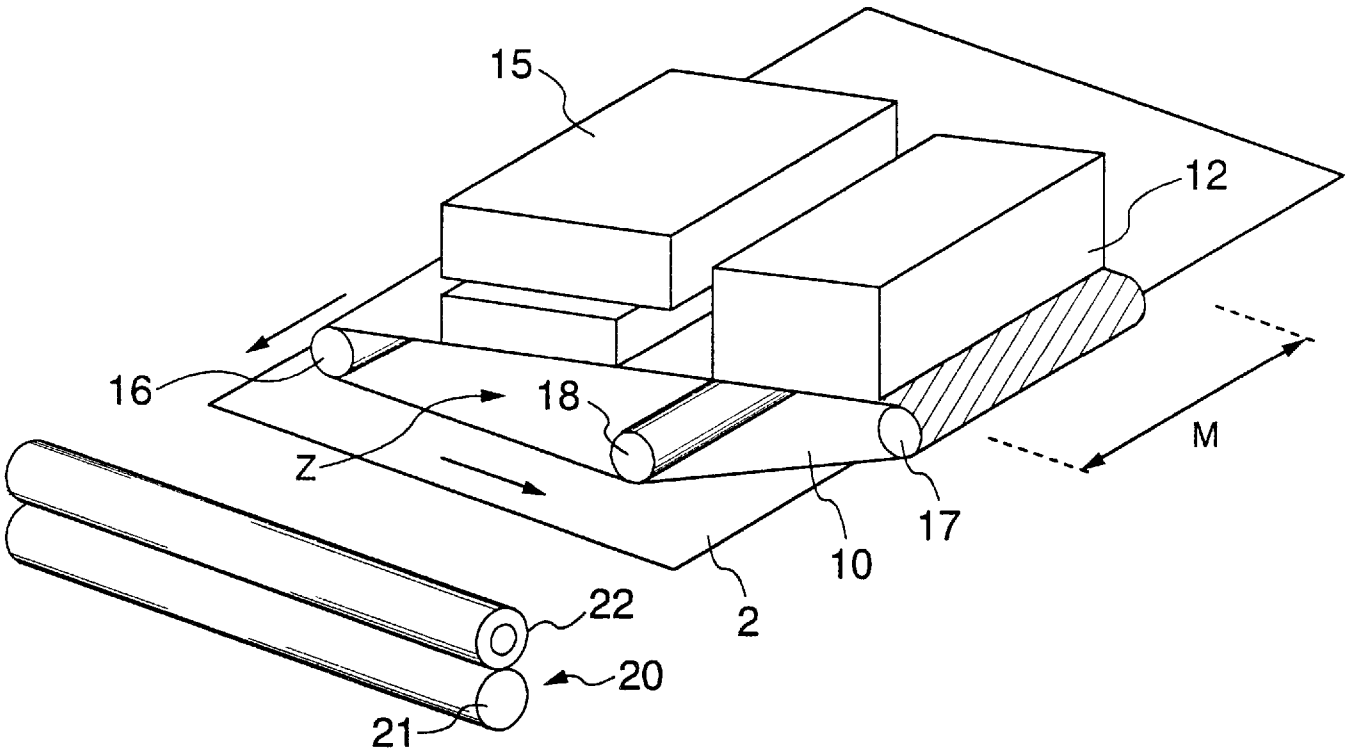
FIG. 7 is a perspective view showing a transfer process performed in the image forming apparatus of the second embodiment.

FIG. 6 is a schematic view showing a construction of an image forming apparatus according to the second embodiment of the invention, and FIG. 7 is a perspective view showing a transfer process performed in the image forming apparatus of the second embodiment. FIGS. 8 to 11 are schematic views showing displacement of a toner image-carrying member in the image forming apparatus of the second embodiment.

In FIGS. 6 to 7, the toner image-carrying member 10 comprising a photosensitive belt having a surface coated with an organic photoconductive material is extended by a plurality of rollers in a direction perpendicular to a direction of feed of printing paper 2, and when forming images, this toner image-carrying member 10 is revolved in a direction indicated by arrows, so that toner images are formed on the surface of the toner image-carrying member 10. This second embodiment differs from the first embodiment in that the toner image-carrying member 10 is extended obliquely (that is, in a slanting manner), and with this arrangement the transfer finish surface Z (see FIG. 7) is not moved away from the printing paper 2 as described later. Static charging means 11, developing means 12, cleaning means 13, static eliminating means 14 and so on are provided around the toner image-carrying member 10, and exposure means 15 for radiation of a laser beam is provided above the toner image-carrying member 10. In this second embodiment, the exposure means 15 typically uses a laser, while an LED or LCD may be used in the exposure means 15. When the toner image-carrying member 10 is revolved in the direction (indicated by the arrows in FIG. 6) perpendicular to the direction of feed of the printing paper 2, that portion of the toner image-carrying member 10, which has passed past the static charging means 11, is electrically charged uniformly at about −600 V, and a potential of that portion of the toner image-carrying member 10, to which a laser beam is radiated from the exposure means 15 in accordance with an image signal, rises to about −100 V to cause an electrostatic latent image to be formed on this portion. When a toner 12*a* is applied by a developing roller 12*b* to this portion having the electrostatic latent image thereon, a toner image (visible image) 12*c* appears on the toner image-carrying member 10. Thus, during the revolution of the toner image-carrying member 10, the toner images 12*c* successively appear on the toner image-carrying member 10.

As shown in FIG. 6, during the image forming operation, the toner image-carrying member 10 is extended by at least three rollers, that is, support roller 16, displacement roller 17 and transfer opposed roller 18, in the direction perpendicular to the direction of feed of the printing paper 2. A longest path of movement of the transfer opposed roller 18 is obtained when selecting the printing paper 2 having a maximum printable width, and those rollers, which come closest to the transfer opposed roller 18 at respective starting and terminal ends (i.e., left end and right end in FIG. 6) of the longest movement path, are made the end rollers. In this second embodiment, the support roller 16 and the displacement roller 17, which are provided respectively at the left and right ends of the longest movement path, serve as the end rollers, respectively. The displacement roller 17 is suitably displaceable so as to adjust the tension of the toner image-carrying member 10, and the transfer opposed roller 18 rolls in opposed relation to a transfer plate 19 to transfer the toner images 12*c* to the printing paper 2. In this second embodiment, since one of the end rollers, i.e., the support roller 16 and the displacement roller 17, that is, the displacement roller 17, is arranged at such a height as not to contact the transfer opposed roller 18, one (that is, the right non-transfer region) of the non-transfer regions R (which have been problematic with the conventional construction of FIGS. 24 and 25), in which the transfer opposed roller 18 can not move, is removed. Therefore, the transfer opposed roller 18 can move beyond the displacement roller (end roller) 17, that is, to the right end of the entire longitudinal width Q of the toner image-carrying member 10, so that a transfer region P, in which the transfer opposed roller 18 can move, is greatly increased.

Figure 8:
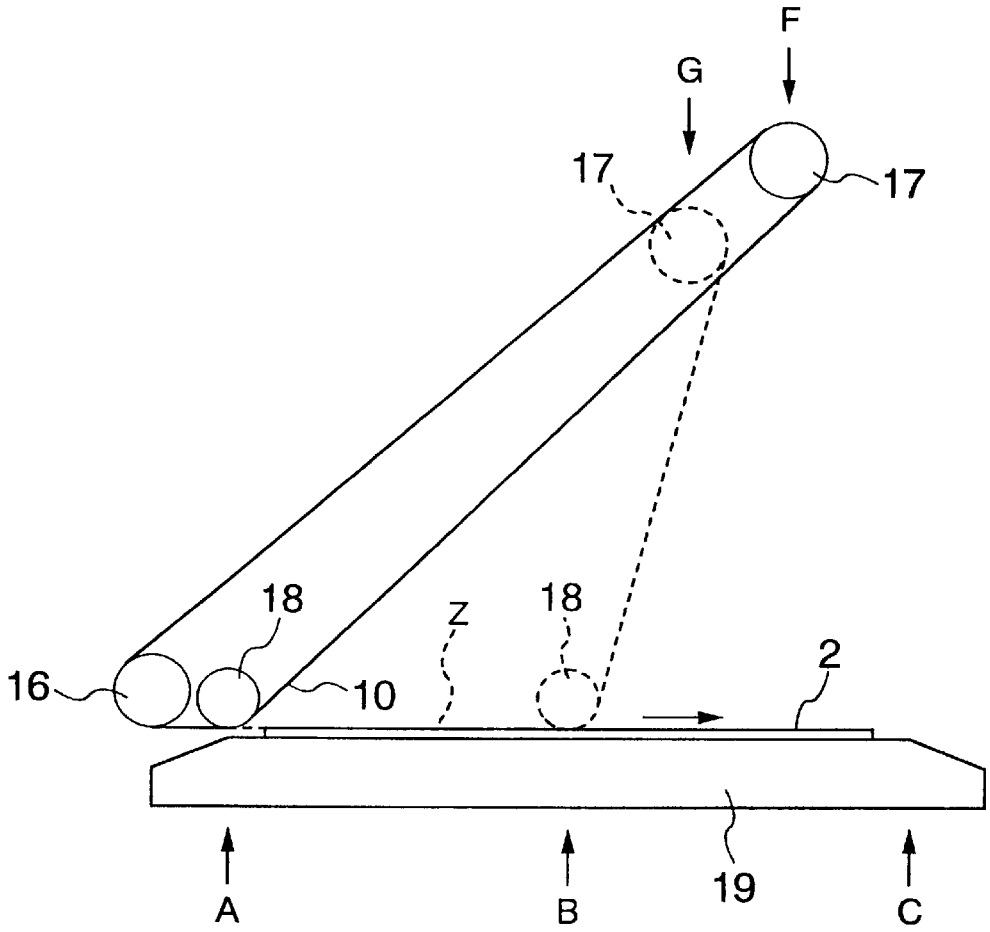
FIGS. 8 to 11 are schematic views showing displacement of a toner image-carrying member in the image forming apparatus of the second embodiment.
Figure 9:
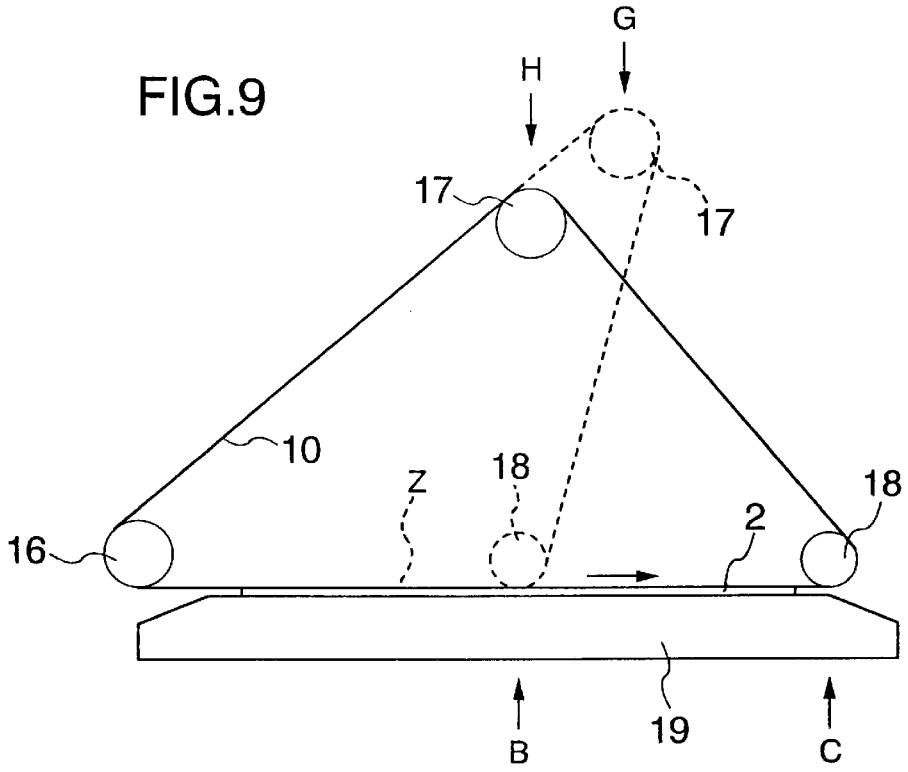
Figure 10:
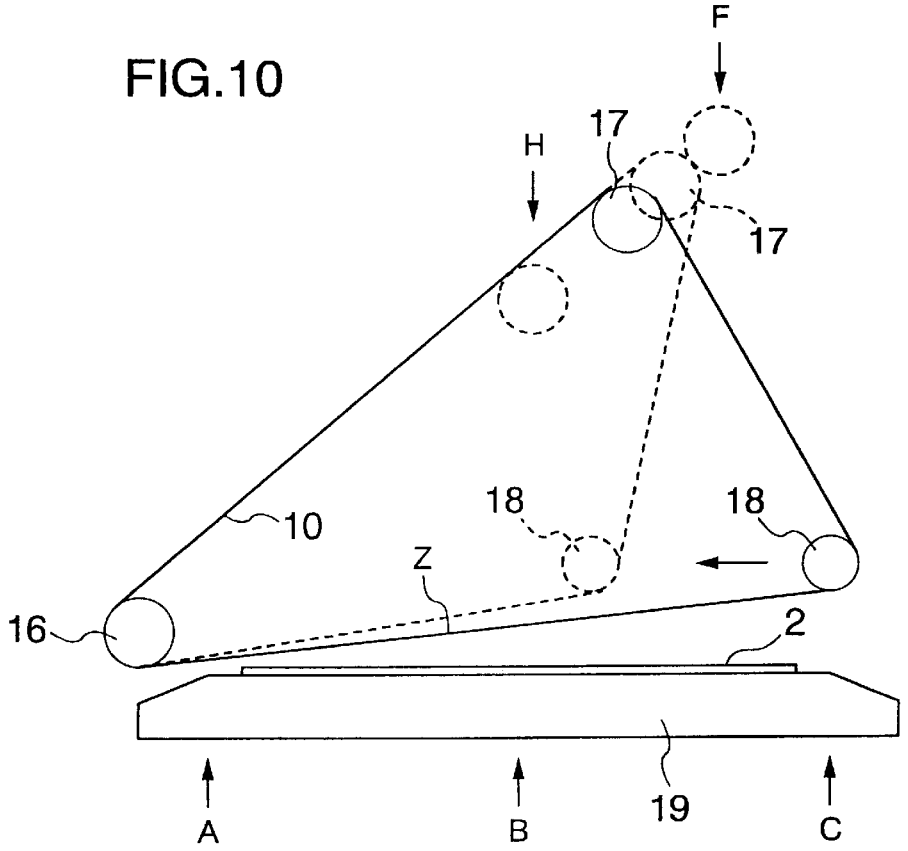

In FIGS. 8 and 9, the displacement roller 17 is displaced in accordance with the movement of the transfer opposed roller 18, and is displaced obliquely so as to eliminate the looseness of the toner image-carrying member 10 caused due to the movement of the transfer opposed roller 18, thereby keeping the tension of the toner image-carrying member 10 at a constant level. For example, when the transfer opposed roller 18 moves from a left end A to an intermediate point B as shown in FIG. 8, the displacement roller 17 moves obliquely from a right end F to an intermediate point G. When the transfer opposed roller 18 moves from the intermediate point B to a right end C as shown in FIG. 9, the displacement roller 17 moves obliquely from the intermediate point G to a left end H.

When the transfer opposed roller 18 moves from the left end A to the right end C, the image transfer operation for one step is finished, and therefore the transfer opposed roller 18 is returned to the position shown in a solid line in FIG. 8 so that the image formation operation can be effected. This returning movement of the transfer opposed roller 18 will be described with reference to FIGS. 10 and 11. As indicated in solid lines in FIG. 10, the displacement roller 17 moves right obliquely from the left end H, and also the transfer opposed roller 18 floats off the right end C, so that the transfer finished surface Z of the toner image-carrying member 10, held in intimate contact with the printing paper 2, is moved away from the printing paper 2 in a manner to form an angle between the transfer finish surface Z and the printing paper 2. The displacement roller 17 further approaches the right end F, and also the transfer opposed roller 18 approaches the left end A in parallel relation to the printing paper 2, and at this time the transfer finished surface Z of the toner image-carrying member 10 never contacts the printing paper 2. The transfer opposed roller 18 is moved parallel to the printing paper 2 until it reaches a position indicated by a broken line in FIG. 11, and after the transfer opposed roller 18 reaches this position indicated by the broken line, it moves downward to return to a position indicated by a solid line in FIG. 11 and also in FIG. 8. The transfer opposed roller 18 is moved along the path shown in FIGS. 8 to 11 when the transfer operation for one step is effected, and in this second embodiment, the transfer of the images is effected only in the going path (or the going stroke) of the transfer opposed roller 18 shown in FIGS. 8 and 9, and is not effected in the return path (or the return stroke) shown in FIGS. 10 and 11. The second embodiment differs in this respect from the first embodiment.

The second embodiment further differs from the first embodiment in that the transfer finished surface Z is held in intimate contact with the printing paper 2 during the transfer of the toner images to the printing surface 2, as shown in FIGS. 8 and 9. Therefore, that portion (which has not yet been transferred) of the toner image-carrying member 10 disposed forwardly of the transfer opposed roller 18 in the direction of advance of the transfer opposed roller 18 is pulled by the transfer opposed roller 18 to have an increased tension, and the transfer finished surface Z, extended between the transfer opposed roller 18 and the support roller 16 and held in intimate contact with the printing paper 2, is also pulled by the transfer opposed roller 18 to have an increased tension. Namely, the toner image-carrying member 10 is pulled by the transfer opposed roller 18 before and behind the transfer opposed roller 18, so that the tension of the toner image-carrying member 10 is kept at a constant level. Therefore, unlike the first embodiment, it is not necessary to minutely rotate the support roller 16 so as to eliminate the looseness of the transfer finished surface Z.

In the second embodiment, when forming the toner images on the toner image-carrying member 10, the transfer opposed roller 18 is fixed at the left end A as shown in FIG. 8, and the toner image-carrying member 10 is kept in a floating condition as indicated in a solid line, and is revolved without displacement, so that the toner images 12*c* thereon are brought into opposed relation to the printing paper 2.

It is to be noted that the toner image-carrying member 10 is revolved only when the transfer opposed roller 18 is fixed at the left end A, and the toner image-carrying member 10 is completely out of contact with the printing paper 2. When the transfer opposed roller 18 moves over the printing paper 2 to form the transfer finish surface Z on the toner image-carrying member 10 (and when the transfer opposed roller 18 has finished its going stroke, and is fixed at the right end C), the revolution of the toner image-carrying member 10 is stopped. Namely, the revolution of the toner image-carrying member 10 and the formation of the transfer finished surface Z are exclusive events with respect to each other, and do not occur at the same time.

For transferring the toner images to the printing paper 2, as shown in FIG. 7, the feed of the printing paper 2 is temporarily stopped to keep the printing paper 2 stationary on the transfer plate 19 (see FIG. 6), and also the revolution of the toner image-carrying member 10 is stopped. Then, those portions of the toner image-carrying member 10, on which the toner images 12*c* are formed, respectively, are sequentially pressed or rubbed against the printing paper 2 by rolling the transfer opposed roller 18 on the reverse side of the toner image-carrying member 10, thereby transferring the toner images 12*c* to the printing paper 2, and at this time the toner image-carrying member 10 is displaced from the left end to the right end to effect the transfer operation for one step. At this time, the transfer finished surface Z of the toner image-carrying member 10 having finished the transfer of the toner images 12*c* is not moved away from the printing paper 2, but is held in intimate contact with the printing paper 2 even after the transfer opposed roller 18 passes the transfer finished surface Z. During the transfer operation, the transfer plate 19, supporting the printing paper 2 thereon, is applied with a positive voltage, and attracts the negatively-charged toner images 12*c*, so that the toner images 12*c* are separated from the surface of the toner image-carrying member 10, and are transferred to the printing paper 2. In this second embodiment, the transfer operation performed by the toner image-carrying member 10 can be effected only in the going path as described above. At this time, when viewing the direction of movement of the toner image-carrying member 10 from the side of the printing paper 2, the toner image-carrying member 10 is displaced on the printing paper 2 in a direction perpendicular to the direction of feed of the printing paper 2.

Figure 11:
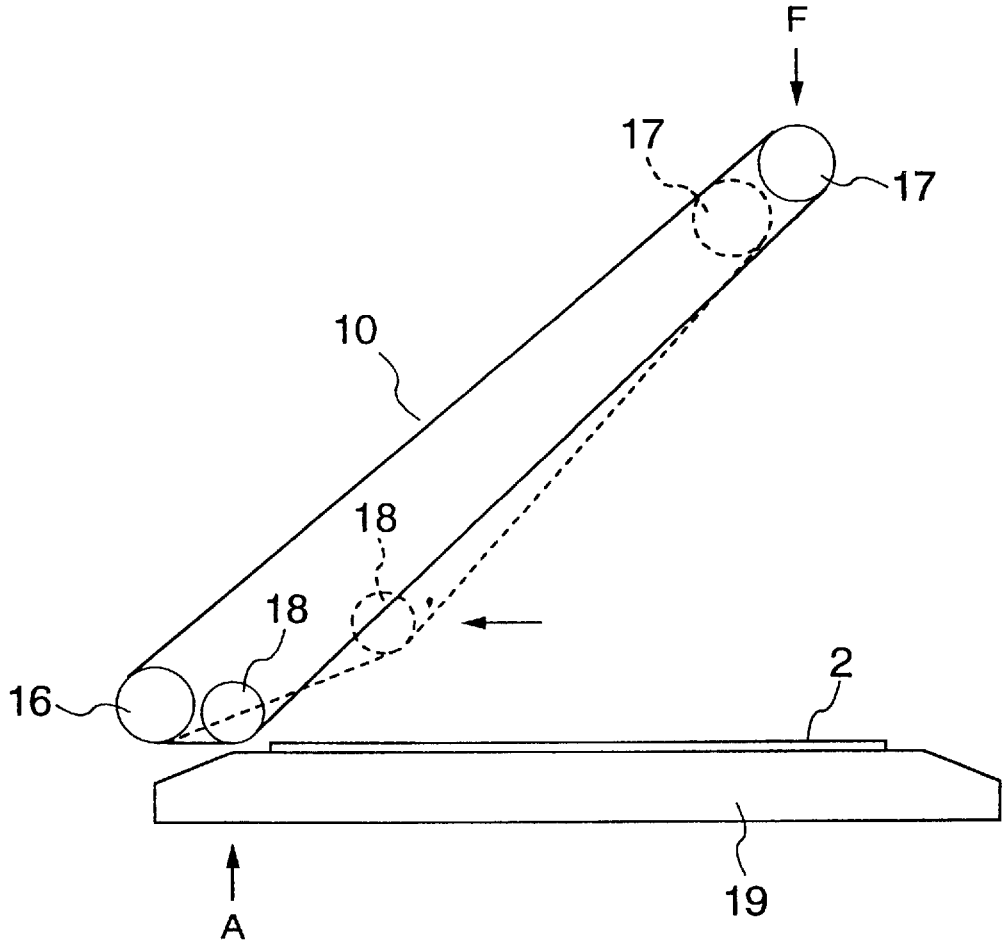

Each time the transfer opposed roller 18 is returned to the position indicated by the solid line in FIG. 11 after the transfer operation for one step is finished, the feed of the printing paper 2 is started, and at this time the printing paper 2 is fed a distance corresponding to an effective transfer width M (see FIG. 7) of the toner image-carrying member 10.

The cleaning means 13 removes the residual toner on the surface of the toner image-carrying member 10 by a cleaning blade or a cleaning brush, and the thus removed toner is recovered as waste toner. Thus, the cleaning means 13 physically cleans the surface of the toner image-carrying member 10. The static eliminating means 14 neutralizes the negative charge residing on the surface of the toner image-carrying member 10, from which the residual toner has been removed, thus electrically cleaning the surface of the toner image-carrying member 10. The provision of the static eliminating means 14 is not essential.

After the above steps are repeated, the printing paper 2 is gradually fed to the fixing means 20 as shown in FIG. 7. In the fixing means 20, the printing paper 2, having the transferred images thereon, is held between a pressure roller 21 and a heating roller 22 containing a heat source therein, and the toner particles are fused by the heating roller 22 to be fixed to the printing paper 2. If this fixing operation is effected after all the images are transferred to the printing paper 2, the printing paper 2 is discharged without being stopped, and therefore the heat source of the heating roller 22 is kept turned on. However, if the images are in the process of being transferred to the printing paper 2, the printing paper 2 is in a stopped condition, and therefore the heat source of the heating roller 22 needs to be temporarily turned off, or the heating roller 22 needs to be moved away from the printing paper 2. Another fixing method as shown in FIG. 5 may be used, in which fixing means 23 comprises the heat source 24 and the reflection plate 25, and the reflection plate 26 is provided below the fixing means 23 so as to enhance a heat efficiency, thereby fixing the toner without contact with the toner. In the manner described above, a sequence of image forming steps are finished.

As described above, in this second embodiment, one of the two end rollers (i.e., the support roller 16 and the displacement roller 17), that is, the displacement roller 17, is arranged at such a height as not to contact the transfer opposed roller 18, and with this arrangement the non-transfer region R, which has been problematic with the conventional construction and in which the transfer opposed roller 18 can not move, can be reduced at that side of the displacement roller 17. As a result, the longitudinal width Q of the tone image-carrying member 10 can be considerably reduced, so that the body of the image forming apparatus can be of a smaller size. And besides, during the transfer operation, the transfer finished surface Z of the toner image-carrying member 10 is not separated from the printing surface 2, but is held in intimate contact with the printing paper 2, and therefore the transfer finished surface Z will not be loosened, so that the tension of the toner image-carrying member 10 is kept at the constant level before and behind the transfer opposed roller 18, thereby enhancing the transfer precision.

A third embodiment of the present invention is generally similar to the second embodiment, and in the third embodiment, one of the end rollers is provided at such a height as not to contact a transfer opposed roller, and with this arrangement a limitation imposed on the one of the end rollers is eliminated, thereby eliminating a non-transfer region, in which the transfer opposed roller can not move, at one end of a path of movement of the transfer opposed roller. Unlike the conventional construction, a transfer finished surface of a toner image-carrying member where the transfer of toner images has been finished is not moved away from printing paper even after the transfer opposed roller passes the transfer finished surface, and therefore the tension of the toner image-carrying member is kept constant before and behind the transfer opposed roller, thereby enhancing the transfer precision. However, the third embodiment differs from the second embodiment in that the toner image-carrying member is revolved by at least two rollers including the displacement roller but not including the transfer opposed roller, so as to form toner images. When forming the images, the transfer opposed roller is not used, and therefore the tension of the toner image-carrying member is stabilized, thereby further enhancing the image forming precision. The third embodiment of the present invention will now be described with reference to FIG. 12 to 17 and FIG. 5.

Figure 12:
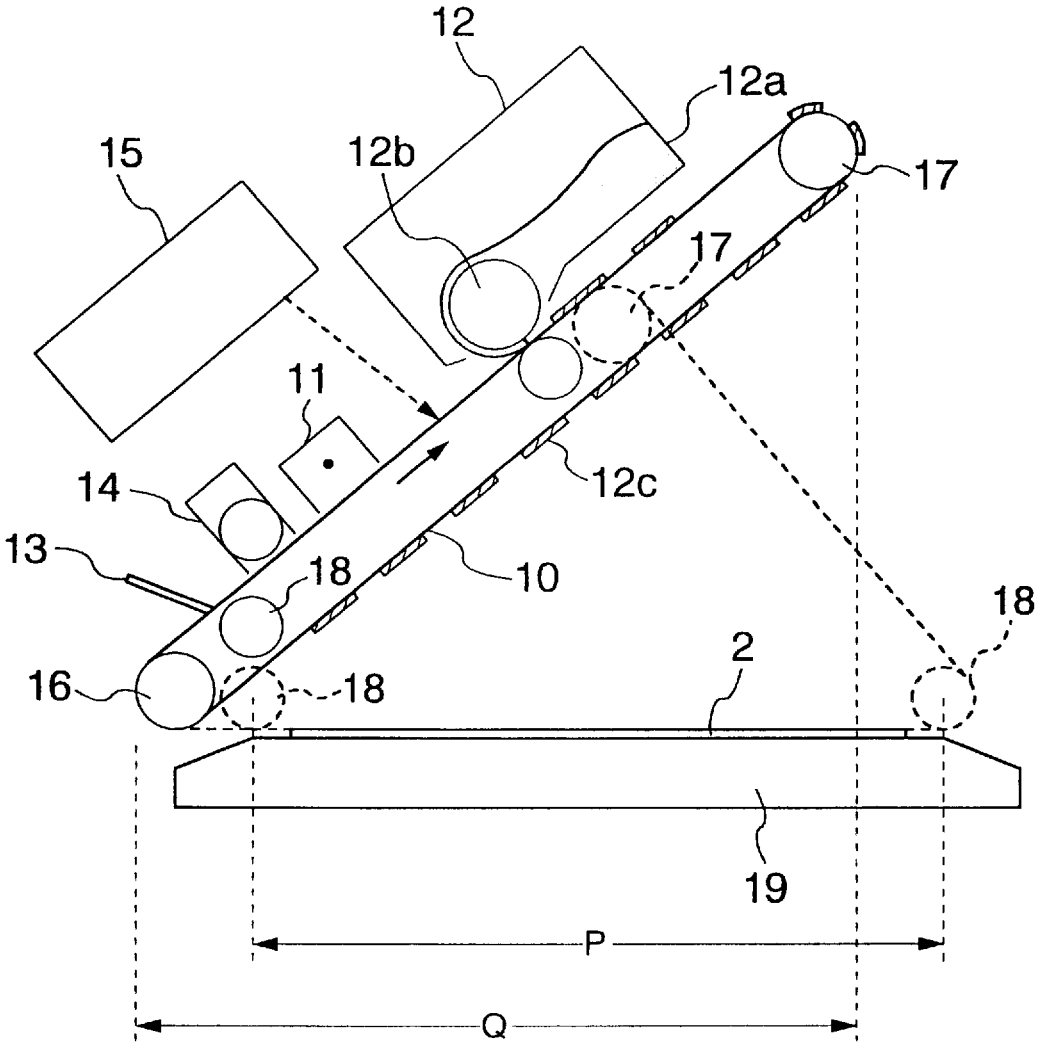
FIG. 12 is a schematic view showing a construction of an image forming apparatus according to a third embodiment of the invention.
Figure 13:
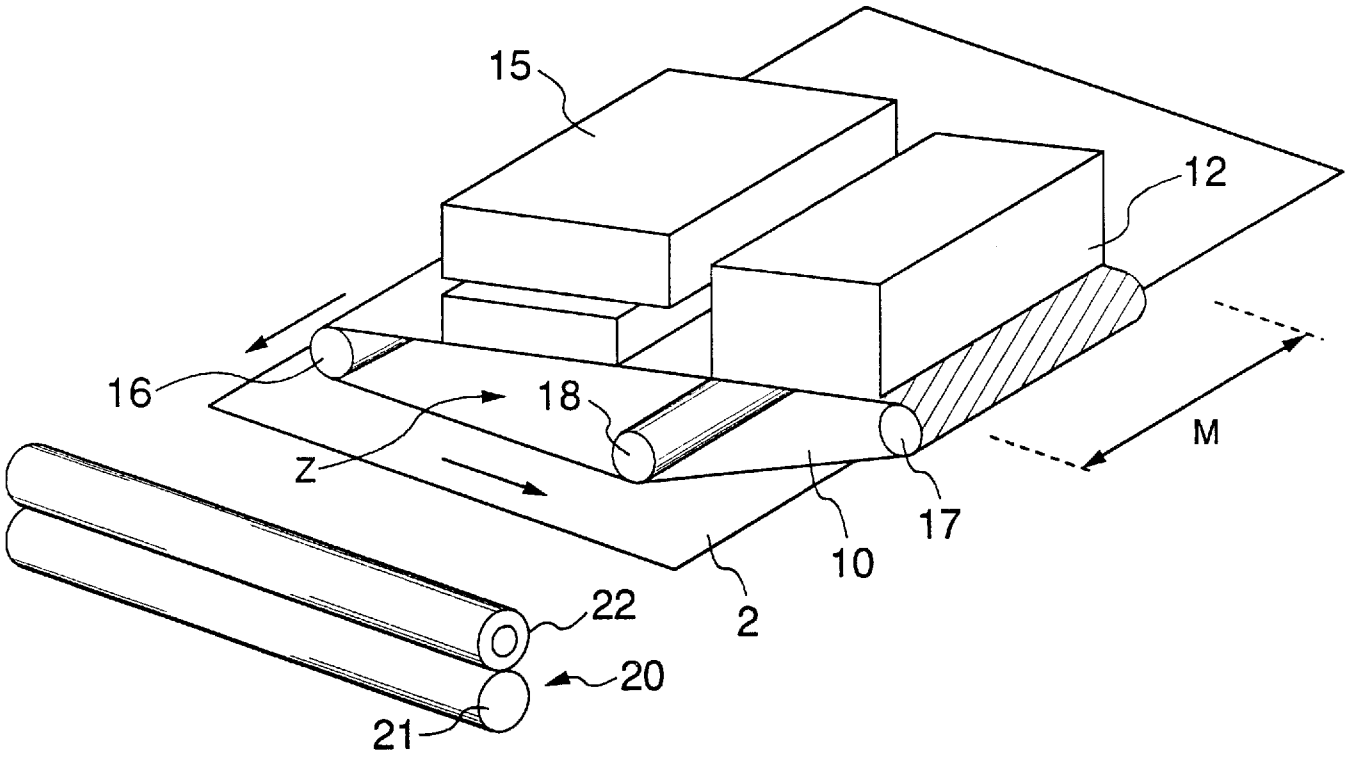
FIG. 13 is a perspective view showing a transfer process performed in the image forming apparatus of the third embodiment.

FIG. 12 is a schematic view showing the construction of an image forming apparatus according to the third embodiment of the invention, and FIG. 13 is a perspective view showing a transfer process by the image forming apparatus of the third embodiment. FIGS. 14 to 17 are schematic views showing displacement of a toner image-carrying member in the image forming apparatus of the third embodiment.

In FIGS. 12 to 13, the toner image-carrying member 10 in the form of a photosensitive belt having a surface coated with an organic photoconductive material, is extended by a plurality of rollers in a direction perpendicular to a direction of feed of printing paper 2, and when forming images, this toner image-carrying member 10 is revolved in a direction indicated by arrows, so that toner images are formed on the surface of the toner image-carrying member 10. This third embodiment differs from the first embodiment in that the toner image-carrying member 10 is extended obliquely (that is, in a slanting manner), and with this arrangement the transfer finished surface Z (see FIG. 13) is not moved away from the printing paper 2 as described later. Static charging means 11, developing means 12, cleaning means 13, static eliminating means 14 and so on are provided around the toner image-carrying member 10, and exposure means 15 for applying a laser beam is provided above the toner image-carrying member 10. In this third embodiment, the exposure means 15 uses a laser while an LED or LCD may be used for the exposure means 15. When the toner image-carrying member 10 is revolved in the direction (indicated by the arrows in FIG. 12) perpendicular to the direction of feed of the printing paper 2, that portion of the toner image-carrying member 10 passed past the static charging means 11 is electrically charged uniformly at about −600 V, and the potential of that portion of the toner image-carrying member 10, to which a laser beam is applied from the exposure means 15 in accordance with an image signal, rises to about −100 V, so that an electrostatic latent image is formed on this portion. When a toner 12*a* is applied by a developing roller 12*b* to a portion having the electrostatic latent image thereon, a toner image (visible image) 12*c* appears on the toner image-carrying member 10. Thus, during the revolution of the toner image-carrying member 10, the toner images 12*c* successively appear on the toner image-carrying member 10.

As shown in FIG. 12, during the image forming operation, the toner image-carrying member 10 is extended by at least two rollers (that is, support roller 16 and displacement roller 17) in the direction perpendicular to the direction of feed of the printing paper 2. The third embodiment is different from the first embodiment in that during the image forming operation, the transfer opposed roller 18 is retracted inside the toner image-carrying member 10, and does not serve as a roller for extending the toner image-carrying member 10. The longest path of movement of the transfer opposed roller 18 is obtained when selecting the printing paper 2 having a maximum printable width, and those rollers, which come closest to the transfer opposed roller 18 respectively at the starting and terminal ends (i.e., left end and right end in FIG. 12) of the longest movement path, serve as end rollers. In the third embodiment, the support roller 16 and the displacement roller 17, which are provided respectively at the left and right ends of the longest movement path, serve as the end rollers, respectively. The displacement roller 17 is suitably displaceable during the transfer operation so as to adjust the tension of the toner image-carrying member 10, and the transfer opposed roller 18 rolls in opposed relation to a transfer plate 19 to transfer the toner images 12*c* from the toner image-carrying member 10 to the printing paper 2.

Figure 24:
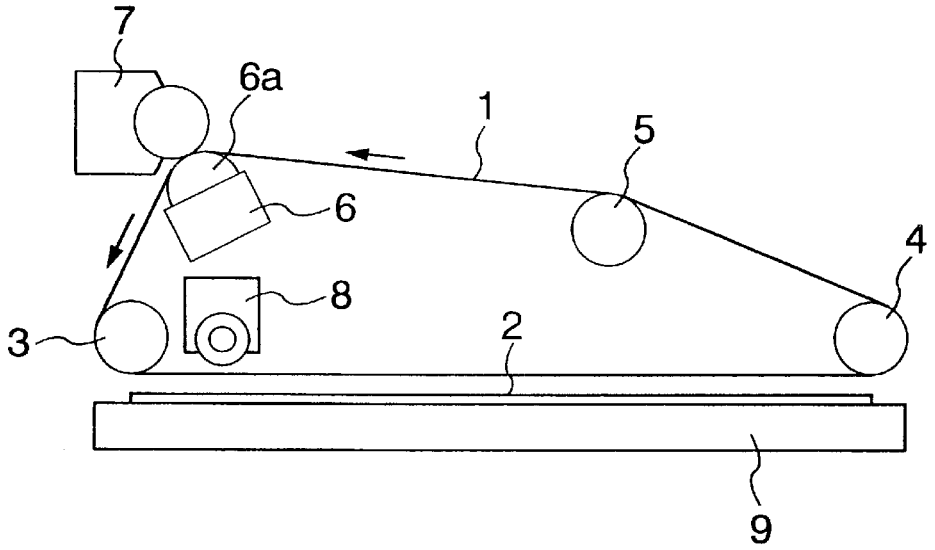
PRIOR ART FIG.24
FIG. 24 is a schematic view showing an image forming process performed in a conventional image forming apparatus.
Figure 25:
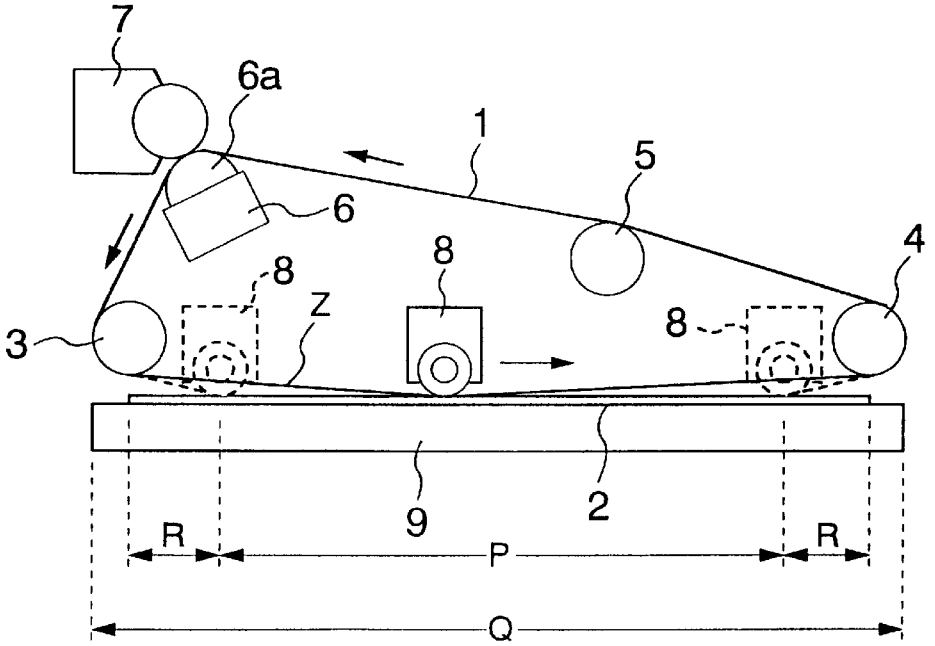
PRIOR ART FIG.25
FIG. 25 is a schematic view showing a transfer process performed in the conventional image forming apparatus.

In the third embodiment, since one of the end rollers (i.e., the support roller 16 and the displacement roller 17), that is, the displacement roller 17, is arranged at such a height as not to contact the transfer opposed roller 18, one (that is, the right non-transfer region) of the non-transfer regions R, which have been problematic with the conventional construction of FIGS. 24 and 25 and in which the transfer opposed roller 18 can not move, is eliminated. Therefore, the transfer opposed roller 18 can move beyond the displacement roller (end roller) 17, that is, to the right end of the entire longitudinal width Q of the toner image-carrying member 10, so that a transfer region P, in which the transfer opposed roller 18 can move, is greatly increased.

Figure 14:
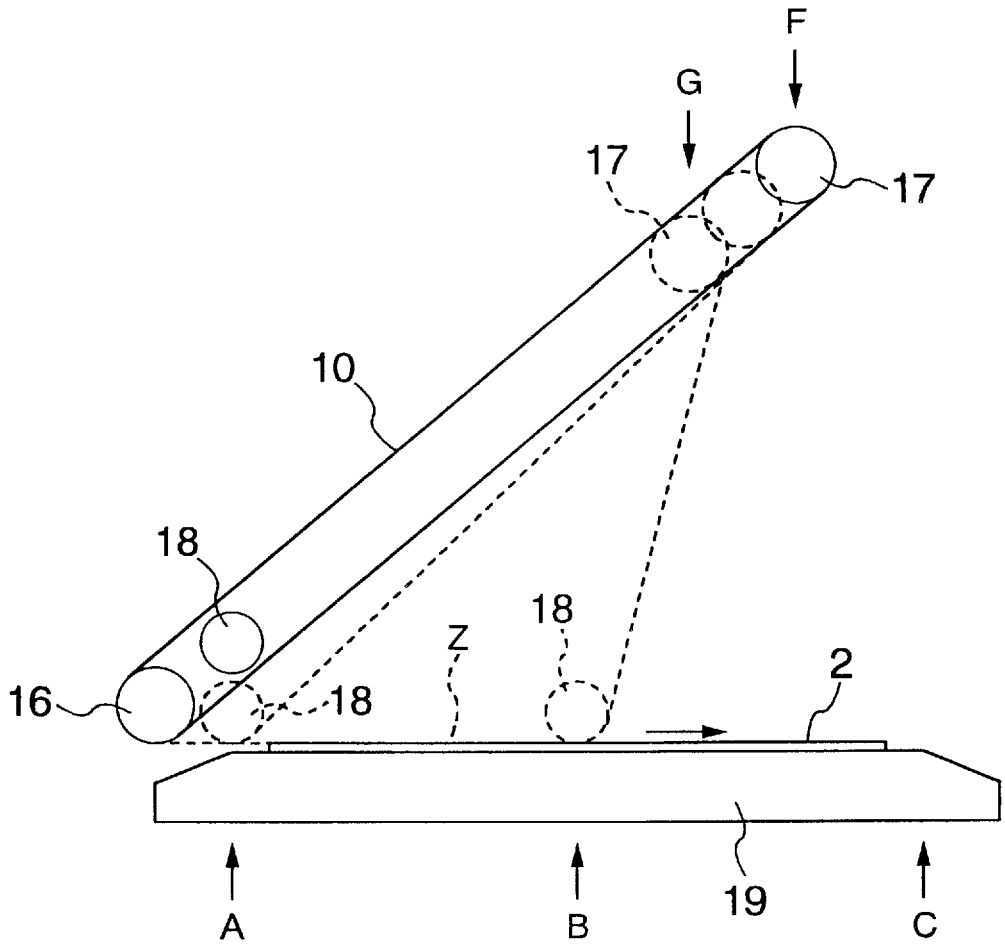
FIGS. 14 to 17 are schematic views showing displacement of a toner image-carrying member in the image forming apparatus of the third embodiment.
Figure 15:
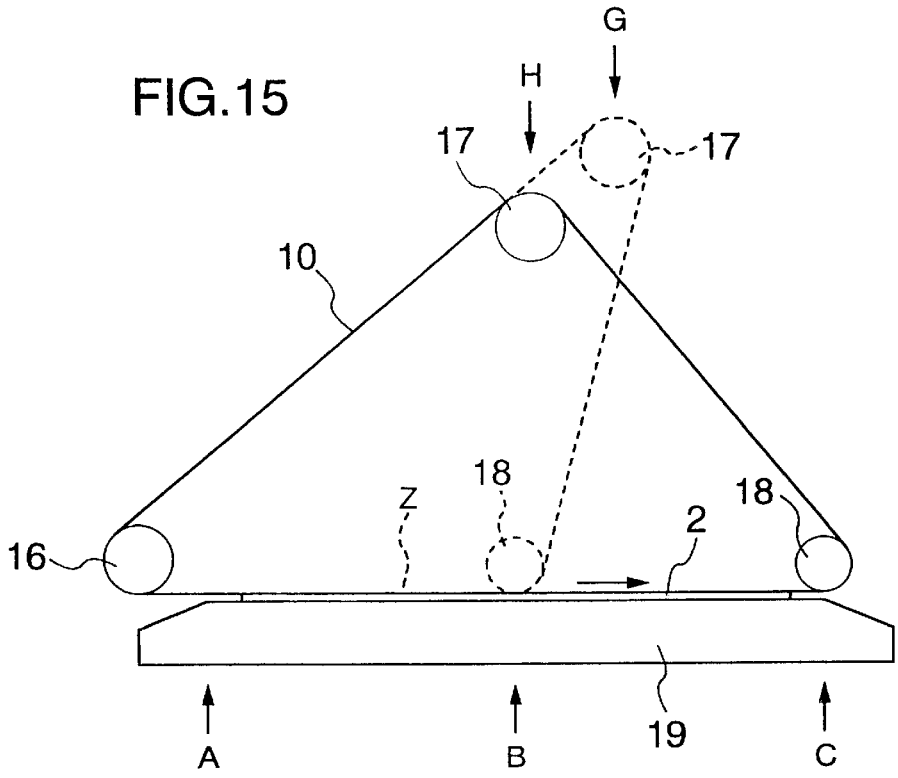
Figure 16:
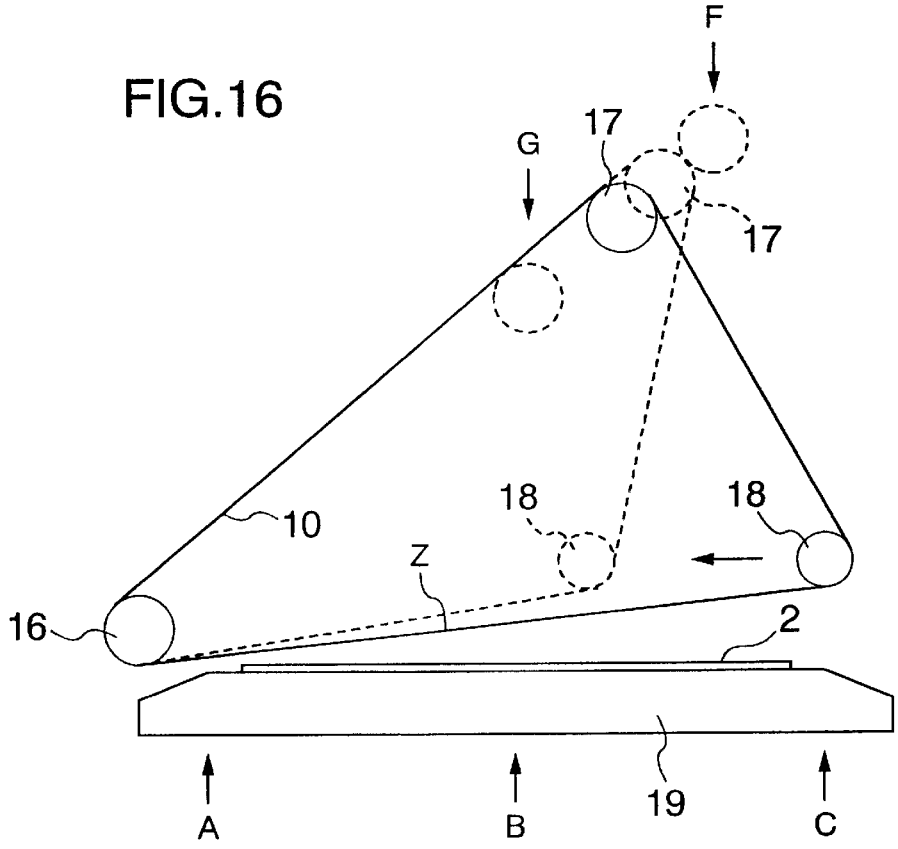

In FIGS. 14 and 15, the displacement roller 17 is displaced in accordance with the movement of the transfer opposed roller 18, and is displaced obliquely so as to eliminate looseness of the toner image-carrying member 10 due to the movement of the transfer opposed roller 18, thereby keeping the tension of the toner image-carrying member 10 at a constant level. For example, when the transfer opposed roller 18 moves downward to a left end A from a retracted position inside the toner image-carrying member 10, and further moves from the left end A to an intermediate point B as shown in FIG. 14, the displacement roller 17 moves obliquely from a right end F to an intermediate point G. When the transfer opposed roller 18 moves from the intermediate point B to a right end C as shown in FIG. 15, the displacement roller 17 moves obliquely from the intermediate point G to a left end H.

When the transfer opposed roller 18 moves from the left end A to the right end C, the image transfer operation for one step is finished, and therefore the transfer opposed roller 18 is returned to the retracted position inside the toner image-carrying member 10, as indicated in a solid line in FIG. 14, so that the image formation operation can be effected. This returning movement of the transfer opposed roller 18 will be described with reference to FIGS. 16 and 17. As indicated in solid lines in FIG. 16, the displacement roller 17 moves right obliquely from the left end H, and also the transfer opposed roller 18 floats off the right end C, so that the transfer finished surface Z of the toner image-carrying member 10, having been held in intimate contact with the printing paper 2, is moved away from the printing paper 2 in a manner to form an angle between the transfer finished surface Z and the printing paper 2. The displacement roller 17 further approaches the right end F, and also the transfer opposed roller 18 approaches the left end A in parallel relation to the printing paper 2, and at this time the transfer finished surface Z of the toner image-carrying member 10 never contacts the printing paper 2. The transfer opposed roller 18 is moved parallel to the printing paper 2 as indicated by a broken line in FIG. 17, and is returned to the retracted position inside the toner image-carrying member 10 as indicated in a solid line in FIG. 17 and also in FIG. 14. The transfer opposed roller 18 is moved along the path shown in FIGS. 14 and 17 when the transfer operation for one step is effected, and in the third embodiment, the transfer of the images is effected only in the going path (or the going stroke) of the transfer opposed roller 18 shown in FIGS. 14 and 15, and is not effected in the return path (or the return stroke) shown in FIGS. 16 and 17. The third embodiment differs in this respect from the first embodiment.

The third embodiment further differs from the first embodiment in that the transfer finished surface Z is held in intimate contact with the printing paper 2 during the transfer of the toner images to the printing surface 2, as shown in FIGS. 14 and 15. Therefore, that portion (which has not yet undergone transfer) of the toner image-carrying member 10 disposed forwardly of the transfer opposed roller 18 in the direction of advance of the transfer opposed roller 18 is pulled by the transfer opposed roller 18 to have an increased tension, and the transfer finished surface Z, extended between the transfer opposed roller 18 and the support roller 16 and held in intimate contact with the printing paper 2, is also pulled by the transfer opposed roller 18 to have an increased tension. Namely, the toner image-carrying member 10 is pulled by the transfer opposed roller 18 before and behind the transfer opposed roller 18, so that the tension of the toner image-carrying member 10 is kept at a constant level. Therefore, it is not necessary to minutely rotate the support roller 16 so as to eliminate looseness of the transfer finished surface Z as in the first embodiment.

In the third embodiment, when forming the toner images on the toner image-carrying member 10, the transfer opposed roller 18 is held in the retracted position inside the toner image-carrying member 10 as shown in FIG. 14, and the toner image-carrying member 10 is kept in a floating condition as indicated in a solid line, and is revolved without displacement, so that the toner images 12*c* thereon are taken to the opposed surface of the printing paper 2.

It is to be noted that the toner image-carrying member 10 is revolved only when the transfer opposed roller 18 is disposed in the retracted position inside the toner image-carrying member 10, and the toner image-carrying member 10 is completely out of contact with the printing paper 2. When the transfer opposed roller 18 moves over the printing paper 2 and the transfer finished surface Z is formed on the toner image-carrying member 10 (and when the transfer opposed roller 18 has finished its going stroke, and is fixed at the right end C), the revolution of the toner image-carrying member 10 is stopped. Namely, the revolution of the toner image-carrying member 10 and the formation of the transfer finished surface Z are exclusive events with respect to each other, and do not occur at the same time.

For transferring the toner images to the printing paper 2, as shown in FIG. 13, the feed of the printing paper 2 is temporarily stopped to keep the printing paper 2 stationary on the transfer plate 19 (see FIG. 12), and also the revolution of the toner image-carrying member 10 is stopped. Then, those portions of the toner image-carrying member 10 on which the toner images 12*c* are formed, respectively, are sequentially pressed or rubbed against the printing paper 2 by rolling the transfer opposed roller 18 on the reverse side of the toner image-carrying member 10, thereby transferring the toner images 12*c* to the printing paper 2, and at this time the toner image-carrying member 10 is displaced from the left end to the right end to effect the transfer operation for one step. At this time, the transfer finished surface Z of the toner image-carrying member 10, on which the transfer of the toner images 12*c* has been finished, is not moved away from the printing paper 2, but is held in intimate contact with the printing paper 2 even after the transfer opposed roller 18 passes the transfer finished surface Z. During the transfer operation, the transfer plate 19, supporting the printing paper 2 thereon, is applied with a positive voltage, and attracts and separates the negatively-charged toner images 12*c* from the surface of the toner image-carrying member 10 to have the images transferred to the printing paper 2. In the third embodiment, the transfer operation by the toner image-carrying member 10 can be effected only in the going path of the transfer opposed roller 18 as described above. At this time, when viewing the direction of movement of the toner image-carrying member 10 from the side of the printing paper 2, the toner image-carrying member 10 is displaced on the printing paper 2 in a direction perpendicular to the direction of feed of the printing paper 2.

Figure 17:
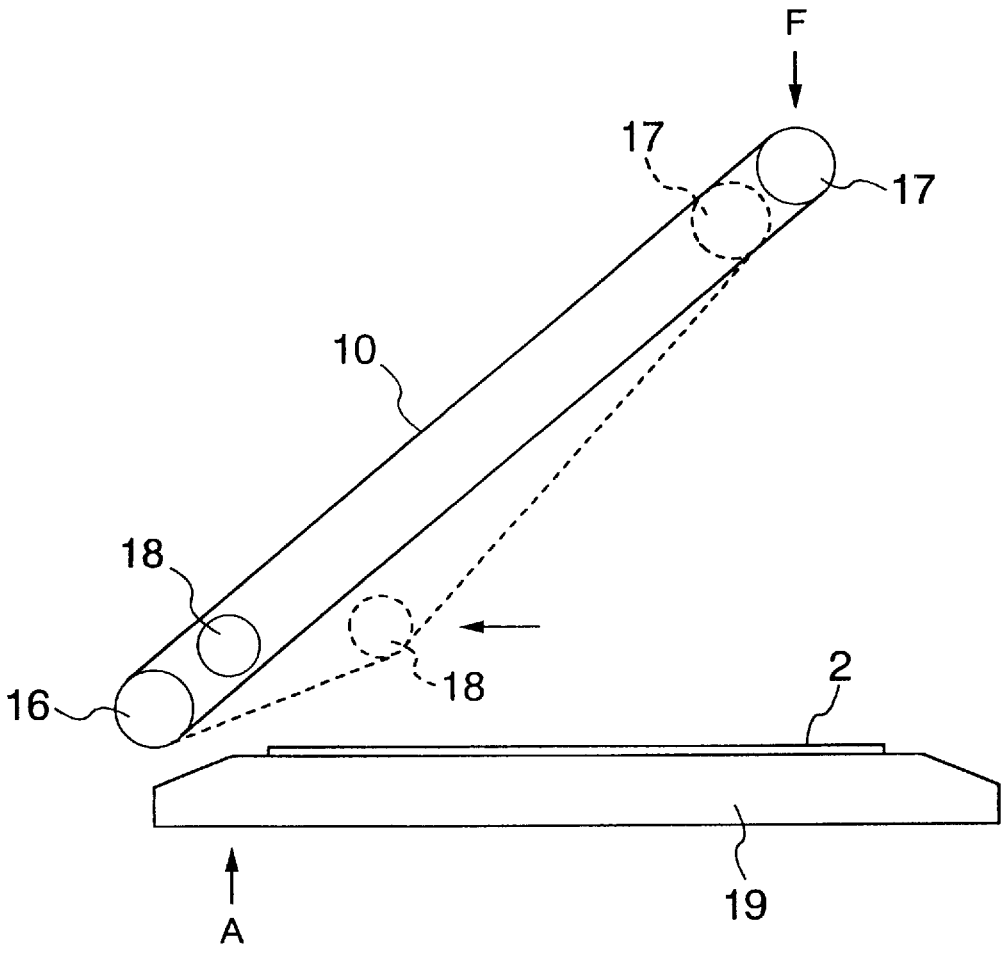

Each time the transfer opposed roller 18 is returned to the position indicated by the solid line in FIG. 17 after the transfer operation for one step is finished, the feed of the printing paper 2 is started, and at this time the printing paper 2 is fed a distance corresponding to an effective transfer width M (see FIG. 13) of the toner image-carrying member 10.

The cleaning means 13 removes the residual toner on the surface of the toner image-carrying member 10 by a cleaning blade or a cleaning brush, and the thus removed toner is recovered as waste toner. Thus, the cleaning means 13 physically cleans the surface of the toner image-carrying member 10. The static eliminating means 14 neutralizes the negative charge residing on the surface of the toner image-carrying member 10 from which the residual toner has been removed, thus electrically cleaning the surface of the toner image-carrying member 10. The provision of the static eliminating means 14 is not essential.

After the above steps are repeated, the printing paper 2 is gradually fed to the fixing means 20 as shown in FIG. 13. In the fixing means 20, the printing paper 2, having the transferred images thereon, is interposed between a pressure roller 21 and a heating roller 22 containing a heat source therein, and the toner particles are fused by the heating roller 22 to be fixed to the printing paper 2. If this fixing operation is effected after all the images are transferred to the printing paper 2, the printing paper 2 is discharged without being stopped, and therefore the heat source of the heating roller 22 is kept turned on. However, if the images are in the process of being transferred to the printing paper 2, the printing paper 2 is in a stopped condition, and therefore the heat source of the heating roller 22 needs to be temporarily turned off, or the heating roller 22 needs to be moved away from the printing paper 2. Another fixing method as shown in FIG. 5 may be used, in which fixing means 23 comprises the heat source 24 and the reflection plate 25 which is provided below the fixing means 23, so as to enhance a heat efficiency, thereby fixing the toner in a non-contact manner. In the manner described above, a sequence of image forming steps is finished.

As described above, in the third embodiment, one of the two end rollers (i.e., the support roller 16 and the displacement roller 17), that is, the displacement roller 17, is arranged at such a height as not to contact the transfer opposed roller 18, and with this arrangement the non-transfer region R, which has been problematic with the conventional construction and in which the transfer opposed roller 18 can not move, is eliminated on that side where the displacement roller 17 is provided, as in the second embodiment. As a result, the longitudinal width Q of the toner image-carrying member 10 can be considerably reduced, so that the body of the image forming apparatus can be made smaller in size. And besides, during the transfer operation, the transfer finished surface Z of the toner image-carrying member 10 is not separated from the printing surface 2, but is held in intimate contact with the printing paper 2, and therefore the transfer finished surface Z will not be loosened, so that the tension of the toner image-carrying member 10 is kept at a constant level before and behind the transfer opposed roller 18, thereby enhancing the transfer precision.

The third embodiment differs from the second embodiment in that the toner image-carrying member 10 is revolved by at least two rollers including the displacement roller 17 but not including the transfer opposed roller 18, so as to form toner images. When forming the images, the transfer opposed roller 18 is not used, and therefore the tension of the toner image-carrying member 10 is stabilized, thereby further enhancing the image forming precision.

A fourth embodiment of the invention is outlined as follows: The developing means, used in the first to third embodiments, is divided into four portions so as to accommodate color images. A basic construction of the fourth embodiment is similar to those of the first to third embodiments. Therefore, as a specific example, there is provided a construction in which the developing means of the first embodiment is divided into four portions for accommodating color images. Only the color image-processing portions will be described in detail, and remaining portions will not be described in detail since these will be easily appreciated from the first to third embodiments. The fourth embodiment of the present invention will now be described with reference to FIGS. 18 to 23 and FIG. 5.

Figure 18:
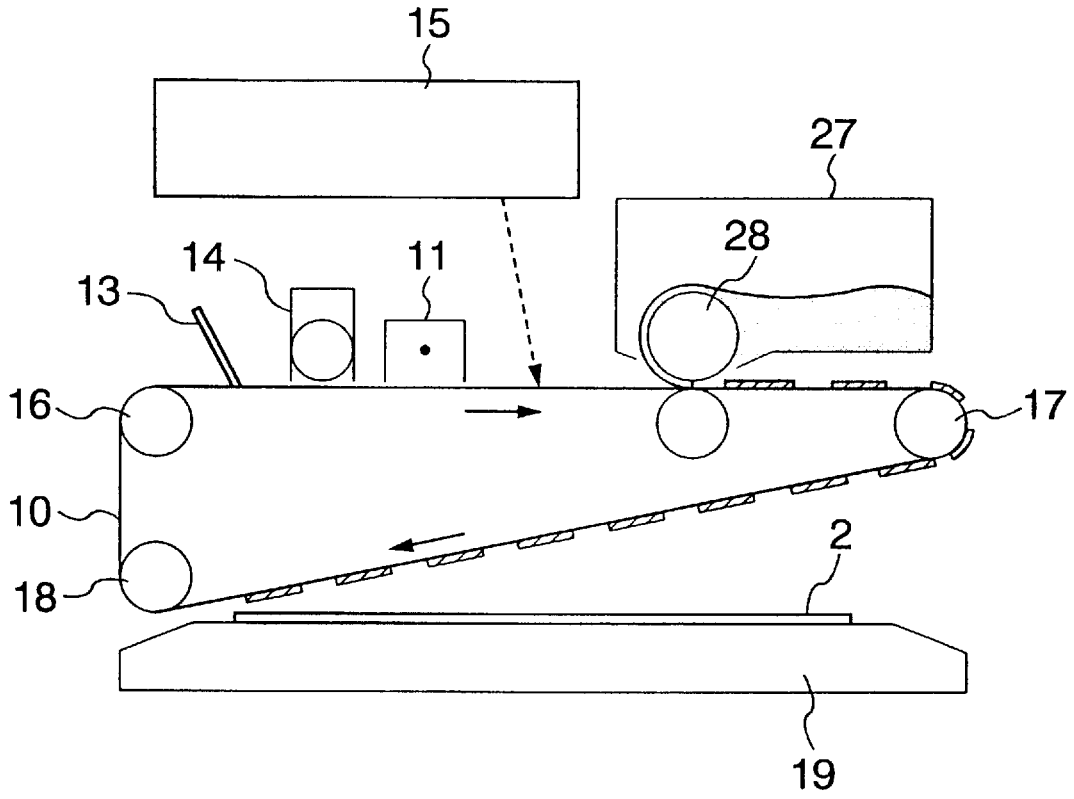
FIG. 18 is a schematic view showing a construction of an image forming apparatus according to a fourth embodiment of the invention.
Figure 19:
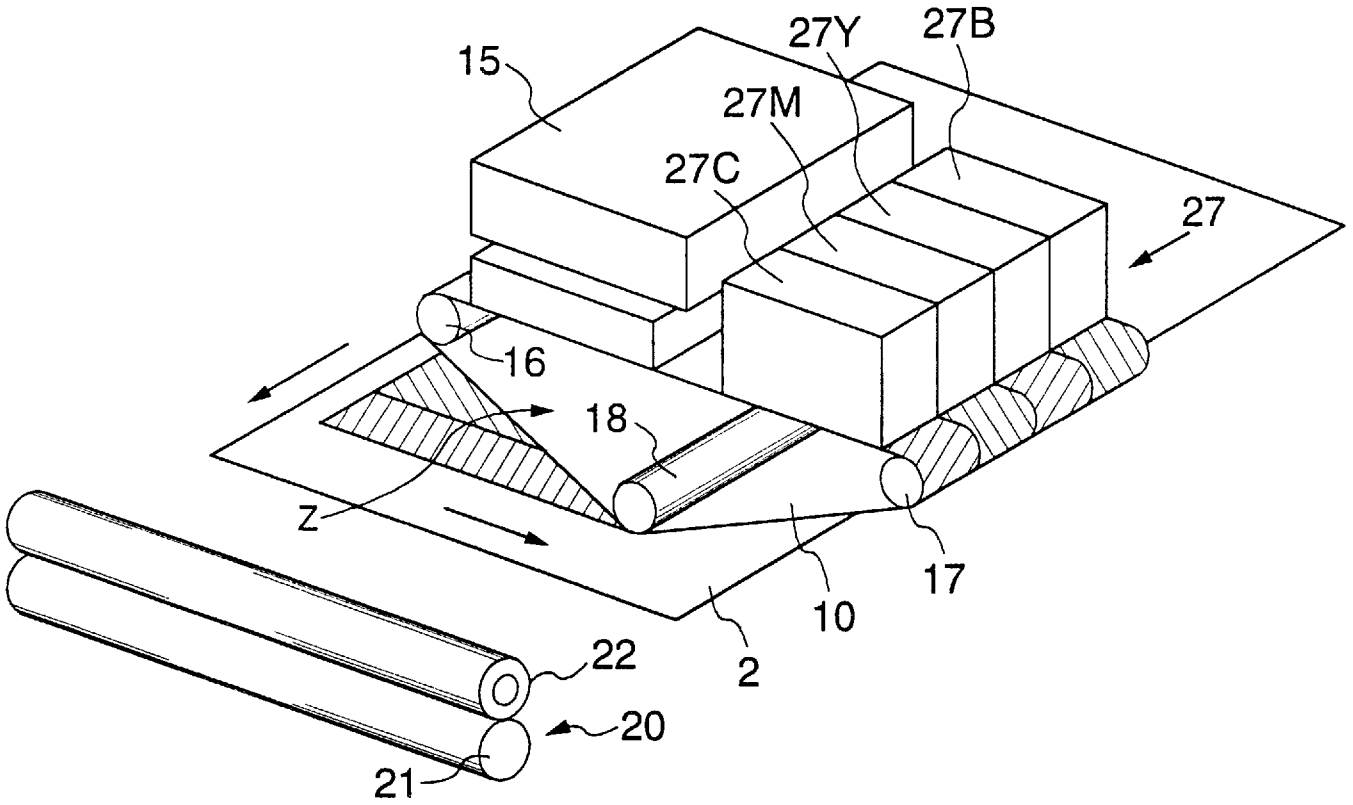
FIG. 19 is a perspective view showing a transfer process performed in the image forming apparatus of the fourth embodiment.

FIG. 18 is a schematic view showing a construction of an image forming apparatus according to the fourth embodiment of the invention, and FIG. 19 is a perspective view showing a transfer process in the image forming apparatus of the fourth embodiment. FIGS. 20 to 23 are schematic views showing the transfer process in the image forming apparatus of the fourth embodiment.

In FIGS. 18 and 19, a toner image-carrying member 10 in the form of a photosensitive belt having a surface coated with an organic photoconductive material, is extended by a plurality of rollers in a direction perpendicular to a direction of feed of printing paper 2, and when forming images, this toner image-carrying member 10 is revolved in a direction indicated by arrows to permit toner images to be formed on the surface of the toner image-carrying member 10. Static charging means 11, developing means 27, cleaning means 13, static eliminating means 14 and so on are provided around the toner image-carrying member 10, and exposure means 15 for radiating a laser beam is provided above the toner image-carrying member 10. In this fourth embodiment, the exposure means 15 typically uses a laser while an LED or LCD may be used for the exposure means 15. When the toner image-carrying member 10 is revolved in the direction, indicated by the arrows in FIG. 18, perpendicular to the direction of feed of the printing paper 2, that portion of the toner image-carrying member 10 having passed past the static charging means 11 is electrically charged uniformly at about −600 V. In accordance with image signals, respectively, corresponding to four primary colors including cyan, magenta, yellow and black, laser beams, respectively, corresponding respectively to the four primary colors, are radiated in a line to the surface of the toner image-carrying member 10. The potential of that portion of the toner image-carrying member 10, to which the laser beams have been radiated, rises to about −100 V, so that electrostatic latent images, distinguished from one another in accordance with the four primary colors, are formed simultaneously on the surface of the toner image-carrying member 10. When toners of four primary colors are applied by a developing roller 28 to the portion having the electrostatic latent images formed thereon, a color toner image (visible image) appears on the toner image-carrying member 10, and in this manner the color toner images successively appear on the toner image-carrying member 10.

The developing means 27 comprises four sections, respectively, corresponding to the four primary colors, and four developing means 27C, 27M, 27Y and 27B contain a cyan toner, a magenta toner, a yellow toner and a black toner, respectively, to form four separate toner layers of the four primary colors (cyan, magenta, yellow and black), respectively, on the common developing roller 28. Actually, a gap is formed between two adjacent ones of the four separate toner layers of the four primary colors, and a ratio of a width of each toner layer to the gap is, for example, 1:1, 2:1 or 3:1. However, for simplifying the description, it is assumed that the four separate toner layers of the four primary colors are formed ideally without any gap between two adjacent toner layers. The printing paper 2 is fed a distance corresponding to a width of one color toner layer.

In the fourth embodiment, the four primary colors are developed at the same time by the common developing roller 28 having the four separate toner layers of the four primary colors formed thereon. In the developing operation, in order to convert the electrostatic latent images, respectively, corresponding to the four primary colors, into respective visible images, the developing roller 28, having the negatively-charged four toner layers of the four primary colors adhered thereto, is pressed against the toner image-carrying member 10, so that the four primary color toners are transferred to the electrostatic latent images distinguished from one another for the four primary colors, thereby forming the toner images of the four primary colors (cyan, magenta, yellow and black) distinguished from one another for the four primary colors.

In transferring the toner images to the printing paper 2, as shown in FIG. 19, the feed of the printing paper 2 is temporarily stopped to keep the printing paper 2 stationary on a transfer plate 19 (see FIG. 18), and also the revolution of the toner image-carrying member 10 is stopped. Then, those portions of the toner image-carrying member 10, on which the color toner images are formed, are sequentially pressed or rubbed against the printing paper 2 by rolling a transfer opposed roller 18 on the reverse side of the toner image-carrying member 10, thereby transferring the color toner images to the printing paper 2, and at this time the toner image-carrying member 10 is displaced from the left end to the right end or vice versa a distance corresponding to one step. At this time, a transfer finished surface Z of the toner image-carrying member 10, for which the transfer of the color toner images has been finished, is gradually moved away from the printing paper 2 as the transfer opposed roller 18 passes. During the transfer operation, the transfer plate 19, supporting the printing paper 2 thereon, is applied with positive voltage, and attracts and separates the negatively-charged color toner images from the surface of the toner image-carrying member 10 to have the images transferred to the printing paper 2. The transfer operation by the toner image-carrying member 10 can be effected not only in the going path, but also in the return path (or the return stroke) as described above. At this time, when viewing the direction of movement of the toner image-carrying member 10 from the side of the printing paper 2, the toner image-carrying member 10 is displaced on the printing paper 2 in a direction perpendicular to the direction of feed of the printing paper 2.

Each time the transfer operation for one step is finished, the transfer opposed roller 18 passes over the printing paper 2 to a region outside the printing paper 2, so that the toner image-carrying member 10 is spaced apart from the printing paper 2. Then, the feed of the printing paper 2 is started, and at this time the printing paper 2 is fed a distance corresponding to a width of one color toner layer.

Figure 20:
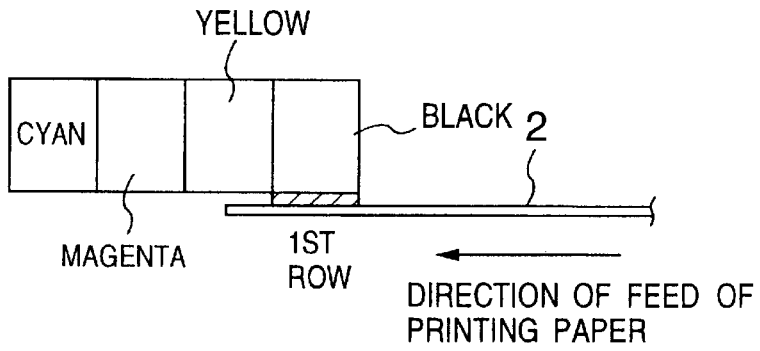
FIGS. 20 to 23 are schematic views showing the transfer process performed in the image forming apparatus of the fourth embodiment.
Figure 21:
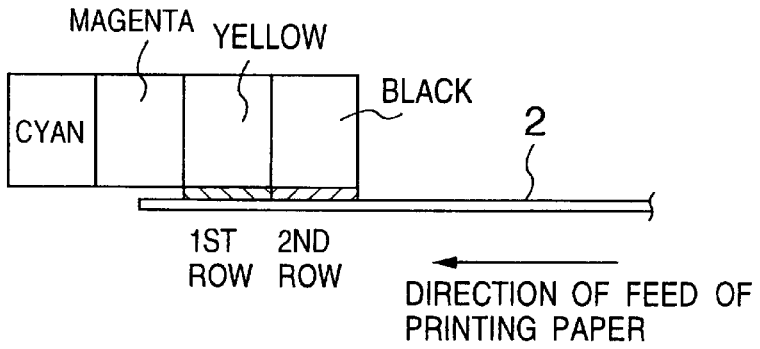
Figure 22:
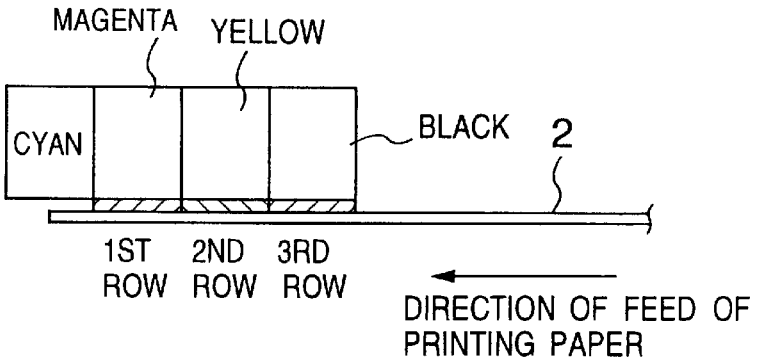
Figure 23:
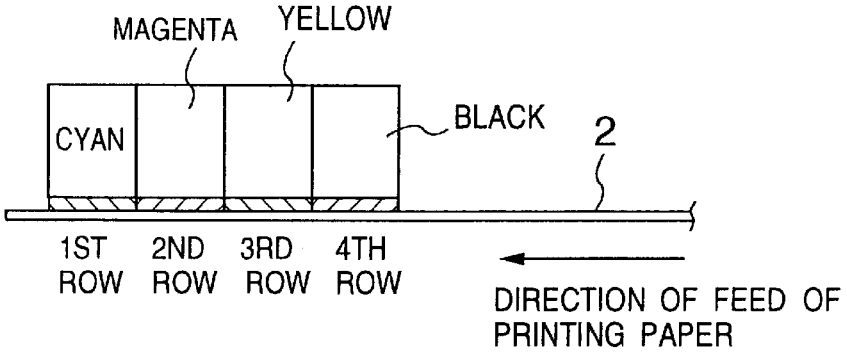

In the method of forming color toner images in the fourth embodiment, first, only the black toner image is transferred in one step as shown in FIG. 20. In the next step shown in FIG. 21, the black and yellow toner images are transferred such that the black and yellow toner layers are superimposed in a first row. Similarly, in the next step shown in FIG. 22, the black, yellow and magenta toner images are transferred such that the black, yellow and magenta toner images are superimposed in the first row, and the black and yellow toner images are superimposed in a second row. In the next step shown in FIG. 23, the black, yellow, magenta and cyan toner images are transferred such that a color (multi-color) image is formed in the first row by the superimposed black, yellow, magenta and cyan toner images, the black, yellow and magenta toner images are superimposed in the second row, and the black and yellow toner images are superimposed in a third row. At subsequent steps, the transfer operation is carried out in a reverse manner. More specifically, in the next step, the yellow, magenta and cyan toner images except for the black toner image are transferred, and in the next step, the magenta and cyan toner images (further except for the yellow toner image) are transferred. Finally, only the cyan toner image is transferred.

The cleaning means 13 removes the residual toner on the surface of the toner image-carrying member 10 by a cleaning blade or a cleaning brush to recover the same as waste toner. Thus, the cleaning means 13 physically cleans the surface of the toner image-carrying member 10. The static eliminating means 14 neutralizes the negative charge residing on the surface of the toner image-carrying member 10, from which the residual toner has been removed, thus electrically cleaning the surface of the toner image-carrying member 10. The provision of the static eliminating means 14 is not essential.

After the above steps are repeated, the printing paper 2 is gradually fed toward fixing means 20 as shown in FIG. 19. In the fixing means 20, the printing paper 2, having the transferred images thereon, is interposed between a pressure roller 21 and a heating roller 22 containing a heat source therein, and the toner particles are fused by the heating roller 22 to be fixed to the printing paper 2. If such fixing operation is effected after all the images are transferred to the printing paper 2, the printing paper 2 is discharged without being stopped, and therefore the heat source of the heating roller 22 is kept turned on. However, if the images are in the process of being transferred to the printing paper 2, the printing paper 2 is in a stopped condition, and therefore the heat source of the heating roller 22 needs to be temporarily turned off, or the heating roller 22 needs to be moved away from the printing paper 2. Another fixing method as shown in FIG. 5 may be used, in which fixing means 23 comprises the heat source 24 and the reflection plate 25, and the reflection plate 26 is provided below the fixing means 23 so as to enhance a heat efficiency, thereby fixing the toner in a non-contact manner. In the manner described above, a sequence of image forming steps are finished.

As described above, in the fourth embodiment, at least one of the two end rollers (i.e., the support roller 16 and the displacement roller 17) is arranged at such a height as not to contact the transfer opposed roller 18, and with this arrangement the non-transfer region R, which has been problematic with the conventional construction and in which the transfer opposed roller 18 can not move, is eliminated on at least one of the left and right sides. As a result, the longitudinal width Q of the tone image-carrying member 10 can be considerably reduced, so that the body of the image forming apparatus can be made smaller in size.

Finally, briefly describing the present invention as set forth in one embodiment, the toner image-carrying member does not always need to comprise a photosensitive member, and in some cases the exposure means is not needed. For example, a toner image can be formed by forming an electrostatic latent image by means of a heat source to develop the same. Alternatively, toner coated all over the surface of the toner image-carrying member is blown off the surface by a jet of air to enable forming a toner image as in carving or engraving.

As described above, in the image forming apparatus of the transverse transfer type according to the present invention, the toner images, carried by the toner-image carrying member extended by the plurality of rollers in the direction perpendicular to the direction of feed of the printing paper, are transferred by the transfer opposed roller to the printing paper in the direction perpendicular to the direction of feed of the printing paper, and the toner images thus transferred to the printing paper are fixed. Among the rollers extending the toner image-carrying member, at least one of those rollers except for the transfer opposed roller, which comes closest to the transfer opposed roller at the starting and terminal ends, respectively, of the longest path of movement of the transfer opposed roller, is provided at such a height as not to contact the transfer opposed roller. With this construction, the non-transfer region, in which the transfer opposed roller can not move, is reduced, and therefore the body of the image forming apparatus can be made smaller in size.

What is claimed is:

1. An image forming apparatus of transverse transfer type for transferring toner images to printing paper, said apparatus comprising:

a plurality of rollers;

a toner image carrying member stretched around said plurality of rollers in a direction perpendicular to a feeding direction of said printing paper, said toner image carrying member carrying said toner images;

said plurality of rollers comprising a transfer opposed roller for use in transferring said toner images to a surface of said paper to adhere the toner images to the printing paper by movement along a movement path adjacent to said printing paper and at least one roller which is disposed at a position located closest, among all said plurality of rollers except said transfer opposed roller, to a starting end or a terminal end of said movement path, said at least one roller being spaced a distance, in a direction perpendicular to said surface of the printing paper, from said surface of the printing paper, said distance being greater than a diameter of said transfer opposed roller.

2. Apparatus according to claim 1, wherein said toner image carrying member comprises a photosensitive belt, and further comprising exposure means for exposing said toner image carrying member in accordance with image signals, and developing means for developing said toner image carrying member.

3. Apparatus according to claim 2, further comprising exposure means for simultaneously exposing said toner image carrying member at one line in accordance with image signals for respective four primary colors, and developing means for providing toners of respective four primary colors and forming toner layers on a same developing roller for respective four primary colors.

4. Apparatus according to claim 1, wherein at least one of said plurality of rollers comprises a displacement roller which is displaced following movements of said transfer opposed roller.

5. Apparatus according to claim 4, wherein while transfer of the toner images to said surface of said printing paper is performed, said plurality of rollers, except for said transfer opposed roller and said displacement roller, are rotated.

6. Apparatus according to claim 4, wherein while transfer of the toner images to said surface of said printing paper is performed, said plurality of rollers, except for said transfer opposed roller and said displacement roller, are enabled to be rotated.

7. Apparatus according to claim 4, wherein said plurality of rollers includes three or more rollers including said transfer opposed roller and said displacement roller to revolve said toner image carrying member to form toner images.

8. Apparatus according to claim 1, wherein while said transfer opposed roller performs transfer of the toner images to said surface of said printing paper, a transfer-finished surface of said toner image carrying member, on which transfer of the toner images to said surface of said printing paper has finished, is sequentially moved away from said surface of the printing paper.

9. Apparatus according to claim 8, wherein said plurality of rollers includes three or more rollers including said transfer opposed roller and said displacement roller to revolve said toner image carrying member to form toner images.

10. Apparatus according to claim 1, wherein while said transfer opposed roller performs transfer of the toner images to said surface of said printing paper, a transfer-finished surface of said toner image carrying member, on which transfer of the toner images to said surface of said printing paper has finished, is not moved away from said surface of the printing paper.

11. Apparatus according to claim 10, wherein said plurality of rollers includes two or more rollers including said displacement roller but not including said transfer opposed roller to revolve said toner image carrying member to form toner images.

12. An image forming apparatus of transverse transfer type for transferring toner images to printing paper, said apparatus comprising:

a plurality of rollers;

a toner image carrying member stretched around said plurality of rollers in a direction perpendicular to a feeding direction of said printing paper, said toner image carrying member carrying said toner images;

said plurality of rollers including a transfer opposed roller for use in transferring said toner images to a surface of said paper to adhere the toner images to the printing paper, and wherein, while said transfer opposed roller performs transfer of the toner images to said surface of said printing paper, a transfer-finished surface of said toner image carrying member, on which transfer of the toner images to said surface of said printing paper has finished, is not moved away from said surface of the printing paper.

13. Apparatus according to claim 12, wherein at least one said plurality of rollers comprises a displacement roller which is displaced following movements of said transfer opposed roller.

14. Apparatus according to claim 13, wherein while transfer of the toner images to said surface of said printing paper is performed, said plurality of rollers, except for said transfer opposed roller and said displacement roller, are rotated.

15. Apparatus according to claim 13, wherein while transfer of the toner images to said surface of said printing paper is performed, said plurality of rollers, except for said transfer opposed roller and said displacement roller, are enabled to be rotated.

16. Apparatus according to claim 12, wherein said plurality of rollers includes two or more rollers including said displacement roller but not including said transfer opposed roller to revolve said toner image carrying member to form toner images.

17. Apparatus according to claim 12, wherein said toner image carrying member comprises a photosensitive belt, and further comprising exposure means for exposing said toner image carrying member in accordance with image signals, and developing means for developing said toner image carrying member.

18. Apparatus according to claim 17, further comprising exposure means for simultaneously exposing said toner image carrying member at one line in accordance with image signals for respective four primary colors, and developing means for providing toners of respective four primary colors and forming toner layers on a same developing roller for respective four primary colors.

* * * * *